US012523406B2

(12) United States Patent
Emond et al.

(10) Patent No.: US 12,523,406 B2
(45) **Date of Patent: *Jan. 13, 2026**

(54) METHOD AND APPARATUS FOR THERMALLY PROTECTING AND/OR TRANSPORTING TEMPERATURE SENSITIVE PRODUCTS

(71) Applicant: ILLUMINATE CONSULTING, LLC, Tampa, FL (US)

(72) Inventors: Jean-Pierre Emond, Tampa, FL (US); Melissa Germain, Tampa, FL (US)

(73) Assignee: ILLUMINATE CONSULTING, LLC, Tampa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/406,828

(22) Filed: Jan. 8, 2024

(65) Prior Publication Data

US 2024/0142153 A1 May 2, 2024

Related U.S. Application Data

(63) Continuation of application No. 17/583,516, filed on Jan. 25, 2022, now Pat. No. 11,898,795, which is a (Continued)

(51) Int. Cl.
*F25D 3/06* (2006.01)
*B65D 81/38* (2006.01)
(Continued)

(52) U.S. Cl.
CPC ..... *F25D 3/06* (2013.01); *B65D 81/3816* (2013.01); *F25D 3/08* (2013.01); *F28F 13/00* (2013.01);
(Continued)

(58) Field of Classification Search
CPC ..... F25D 2331/804; F25D 2303/085; F25D 3/08; F25D 3/06; F28F 13/00
See application file for complete search history.

(56) References Cited

U.S. PATENT DOCUMENTS 2,031,254 A 2/1936 Derr
2,045,627 A 6/1936 Wooll
(Continued)

FOREIGN PATENT DOCUMENTS

EP 1470057 B1 10/2004
JP 2006-232331 A 9/2006
(Continued)

OTHER PUBLICATIONS

Dea, Sharon. "Thermal behavior of shipping containers for temperature sensitive products," Master Thesis, Laval University, 2004.

*Primary Examiner* — Ana M Vazquez
(74) *Attorney, Agent, or Firm* — SALIWANCHIK, LLOYD & EISENSCHENK

(57) ABSTRACT

Method and apparatus for thermally protecting a product, when storing and/or shipping a product, to control temperatures products are exposed to. Embodiments increase the amount of time portions of the product experience a desired temperature range and/or reduce the amount of time portions of the product experience temperatures outside a desired temperature range and/or experience an undesirable temperature range. Embodiments incorporate thermally conductive materials, referred to as conductive equalizers, positioned around and/or near the product positioned inside a packaging container, where the conductive materials conduct heat from locations in the package interior to other locations in the package interior. The conductive equalizers conductively transfer heat from hotter portions of the interior of the container to cooler portions of the interior of the container and/or from portions of the interior desired to be
(Continued)

cooled to the cold bank, resulting in a more uniform temperature distribution around the product.

16 Claims, 16 Drawing Sheets

Related U.S. Application Data continuation of application No. 16/430,922, filed on Jun. 4, 2019, now Pat. No. 11,248,831, which is a continuation of application No. 14/747,753, filed on Jun. 23, 2015, now Pat. No. 10,309,709, which is a continuation of application No. PCT/US2013/077600, filed on Dec. 23, 2013.

(60) Provisional application No. 61/787,205, filed on Mar. 15, 2013, provisional application No. 61/745,620, filed on Dec. 23, 2012.

(51) Int. Cl.
*F25D 3/08* (2006.01)
*F28F 13/00* (2006.01)

(52) U.S. Cl.
CPC ..... *F25D 2303/0844* (2013.01); *F25D 2303/0845* (2013.01); *F25D 2303/085* (2013.01); *F25D 2331/804* (2013.01); *F28F 2013/001* (2013.01)

(56) References Cited

U.S. PATENT DOCUMENTS

| | | | |
|---|---|---|---|
| RE20,215 | E | 12/1936 | Wooll |
| 2,322,345 | A | 6/1943 | Cage |
| 2,930,707 | A | 3/1960 | Linnell et al. |
| 3,512,696 | A | 5/1970 | Ebert |
| 5,269,149 | A | 12/1993 | Zeidler |
| 6,773,425 | B1 | 8/2004 | Tamari |
| 7,328,583 | B2 | 2/2008 | Hillman et al. |
| 7,412,846 | B2 | 8/2008 | Sekiya et al. |
| 7,849,708 | B2 | 12/2010 | Goncharko et al. |
| 8,074,465 | B2 | 12/2011 | Heroux et al. |
| 8,250,882 | B2 | 8/2012 | Mustafa et al. |

FOREIGN PATENT DOCUMENTS

| | | | |
|---|---|---|---|
| JP | 2009-149380 | A | 7/2009 |
| KR | 20-0249267 | Y1 | 11/2001 |

Top View

METHOD AND APPARATUS FOR THERMALLY PROTECTING AND/OR TRANSPORTING TEMPERATURE SENSITIVE PRODUCTS

CROSS-REFERENCE TO RELATED APPLICATIONS

This application is a continuation of U.S. patent application Ser. No. 17/583,516, filed Jan. 25, 2022; which is a continuation of U.S. patent application Ser. No. 16/430,922, filed Jun. 4, 2019, now U.S. Pat. No. 11,248,831; which is a continuation of U.S. patent application Ser. No. 14/747,753, filed Jun. 23, 2015, now U.S. Pat. No. 10,309,709; which is a continuation of PCT/US2013/077600, filed Dec. 23, 2013; which claims the benefit of U.S. Provisional Application Ser. No. 61/745,620, filed Dec. 23, 2012 and U.S. Provisional Application Ser. No. 61/787,205, filed Mar. 15, 2013, the disclosures of which are hereby incorporated by reference in their entirety, including all figures and tables.

BACKGROUND OF INVENTION

Embodiments of the subject invention relate to a method and apparatus for controlling a thermal environment of a payload, such as a thermal sensitive product. Embodiments are designed to move heat within an enclosed environment, such as a packaging system for temperature sensitive products, in order to more efficiently use the cold bank (or hot bank) and reduce hot or cold spots inside the packaging system.

The most common packaging systems for transporting temperature sensitive products use an insulated container, such as a Styrofoam container, and a cold bank, such as one or more frozen gel, or ice, packs, to provide thermal protection for a load, product, or payload. Typically, an environment of the load is maintained in a specific temperature range, such as 2-8° C., 20-25° C., or below −20° C., in order to provide thermal protection of the load. The frozen ice packs are typically placed on the top of the load, on the bottom of the load, or on the top and the bottom of the load. FIGS. 1A and 1B show two configurations that utilize the cold bank at the top of the load. In the packaging systems, cold air is moved throughout the container via natural convection to maintain an adequate temperature range, such as 2-8° C. Further, some packaging systems utilize channels on the inside walls, or spacers, to promote natural convection for uniform temperature distribution.

One of the major problems encountered with packaging systems similar to the packaging systems shown in FIGS. 1A-1B, using an insulated container and one or more cold banks, is poor temperature distribution, resulting in uneven temperatures throughout the internal environment of the insulated container. Since cold air is heavier than warm air, the cold air tends to settle at the bottom of the interior of the container, or package, which can expose the portions of the product positioned at the bottom of the interior of the container to freezing conditions. In addition, as warm air rises to the top, the portion of the product at the top of the interior of the package can be exposed to warm temperatures, which can result in the product not maintaining a proper temperature environment. By placing the cold bank at the top of the interior of the container, natural convection will tend to circulate the air within the container and mix the air naturally, allowing for a more uniform temperature distribution. However, a common industry practice is to fill the excess space inside the package with a filling material, such as bubble wrap or paper, in order to prevent shifting of the product and/or packaging components during handling. By filling in the excess space within the interior of the container with filling material, convective flow is diminished, which can result in temperature stratification within the interior of the container and, therefore, products being exposed to too warm and/or too cold temperatures.

Natural convection can be further limited if the packaging system is rotated, which can result in the cold bank not remaining in the desired location. As an example, rotating a container with a cold bank at the top of the interior of the container can result in the cold bank being positioned on the side or at the bottom of the interior of the container. Some packaging systems are used for shipping, often resulting in the container being flipped and/or rotated approximately 20 times during transport (Dea, 2004), resulting in a small probability that the package remains upright during the entire transit. Dea et al. (2006) reported that traditional packaging systems can suffer a reduction in the amount of time in the product experiences the appropriate temperature range by as much as 60% when the container is placed on the container's side or the container is placed upside down during transit.

A more uniform temperature distribution within the interior of the container promotes better thermal protection for products within the container by eliminating significant temperature gradients. A more uniform temperature distribution also allows for optimal effectiveness of cold banks within the container. By optimizing the internal temperature distribution, the cold bank can efficiently use its ability to absorb heat to maintain the product at the proper temperature. Inadequate temperature distribution reduces the effectiveness of the cold bank as the heat from the external environment transfers more to the cold source.

In order to eliminate or reduce temperature gradients, phase change materials have been added to the walls of the packaging system. In U.S. Pat. No. 7,328,528, issued Feb. 12, 2008, and in U.S. Pat. No. 7,849,708, issued Dec. 14, 2010, both disclosed a container with walls filled with phase change liquid (such as water) in order to provide a more uniform temperature inside the main container. Lining the walls with phase change material can reduce the temperature stratification when the package is flipped during transit. Phase change packaging systems can offer more thermal protection as they provide an additional insulative barrier between the external environment and the internal environment. Common phase change materials are water or vegetable oil based, which have very low thermal conductivities. However, phase change materials with shipping systems increases the cost of the insulated shipping container system, adds additional weight to the insulated shipping container that increases the shipping cost, requires more preparation time as the phase change materials need to be conditioned to the proper temperature before being placed inside of the package system, and often require the containers to be reused due to the higher cost.

Accordingly, there is a need for a method and apparatus for packaging temperature sensitive products in order to increase the amount of time the product experiences a desired temperature range and/or reduce the amount of time the product experiences temperatures outside of the desired temperature range.

BRIEF SUMMARY

Embodiments of the subject invention relate to a method and apparatus for thermally protecting products, such as during shipping or storing products, so as to control the temperatures the products are exposed to. Embodiments can increase the amount of time the product and/or portions of the product experience a desired temperature range and/or reduce the amount of time the product and/or portions of the product experience temperatures outside of the desired temperature range and/or experience an undesirable temperature range. Embodiments can incorporate thermally conductive materials, such as aluminum foil, positioned around and/or near the product positioned inside a packaging container, such that the conductive materials conduct heat from one or more locations in the interior of the package to one or more other locations in the interior of the package. These thermally conductive materials can be referred to as conductive equalizers, and can act as thermal conduits. The conductive equalizers can have a variety of shapes and mechanical properties, such as wrapping (e.g., a conductive sheet, such as foil), rigid, and/or semi-rigid. The conductive equalizers can conductively transfer heat from the hotter portions of the interior of the container to cooler portions of the interior of the container and/or from portions of the interior desired to be cooled to the cold bank. Conducting heat from hotter portions to cooler portions, or from portions to be cooled to the cold bank can result in a more uniform temperature distribution around the product. Embodiments can be permanent or temporary and can incorporate materials made completely or partially of a highly conductive material having a high thermal conductivity. Although much of the description of the embodiments of the subject invention relate to the use of a cold bank, the same description applies to embodiments using a hot bank and the heat traveling in the opposite direction.

Specific embodiments create a direct thermal contact between the highly conductive material of the conductive equalizers and the cold bank. Such direct thermal contact can involve, for example, direct physical contact or attachment of the conductive equalizers to the cold bank via a thermally conductive material or structure. Specific embodiments create indirect thermal contact between the conductive equalizers and the cold bank so as to have sufficient heat transfer between the conductive equalizers and the cold bank to accomplish the needed heat transfer of the system. Specific embodiments do not utilize direct contact between the highly conductive material of the conductive equalizer and the cold bank, but rely on heat transfer to and from the interior of the container and the cold bank.

Embodiments can utilize insulated shipping containers for placement of temperature sensitive products, in order to reduce the flow of heat from the outside environment to the product so as to control the temperature the products are exposed to. Embodiments can maintain temperature sensitive products in a specific temperature range, such as 2-8° C., for a desired period of time when the exterior of the package is exposed to a certain temperature or temperature profile. Packaging systems in accordance with the invention can be shipped in an environment that is hotter than the required temperature range that the product is supposed to be exposed to, protecting the product from the heat transferred from the external environment outside the insulated container to the interior of the insulated container. The packaging system protects the product from heat from outside the insulated container entering the packaging system and reaching the temperature sensitive products. In order to avoid a rapid increase in the payload temperature, cold banks such as frozen ice packs and/or refrigerated gel packs, can be used to absorb the heat that is transferred from the environment (outside the container) to the inside of the container before the heat reaches the temperature sensitive products. In order to maintain the temperature the temperature sensitive product is exposed to within a desired temperature range, even when the distance between the cold bank and the temperature sensitive product is wide, a conductive equalizer can be used to allow the cold bank to absorb the heat before it reaches the temperature sensitive product. The conductive equalizer can incorporate a material having high thermal conductivity that can be positioned to conductively transfer heat from one or more locations in the interior of the package to one or more other locations in the interior of the package.

Insulated container systems in accordance with the invention can also utilize natural convection to transfer the heat inside the package to the cold bank. A disadvantage of using natural convection to transfer the heat inside the package is that natural convection is more effective when air gaps exist between the container and the payload in order to allow for the air movement to occur. Natural convection is most effective when the cold bank is on top of the product. However, even when the cold bank is positioned on top of the product when the container is packed, the container is often rotated during shipping, thus making natural convection less effective, if effective at all. Filling materials are often placed in the container around the payload, to secure the payload inside of the package, in order to reduce damage caused by movement. However, the use of filling material can decrease, or eliminate, natural convection, as less free space is available for the air to circulate. Accordingly, incorporation of a high thermal conductivity material to conductively transfer heat from one or more locations in the interior of the package to one or more other locations in the interior of the package can be used in combination with convective heat transfer within the package.

Embodiments of the invention can be used for shipping products in an environment that is colder than the interior of the insulated container, such as during cold weather. In such embodiments, a thermal bank that is warmer than the environment outside of the package can be used, such as room temperature gel packs. The heat will move from the thermal bank toward the conductive material, having a high thermal conductivity, which reduces, or possibly prevents, the payload from losing heat to the cold surroundings.

DETAILED DISCLOSURE

Figure 1A:
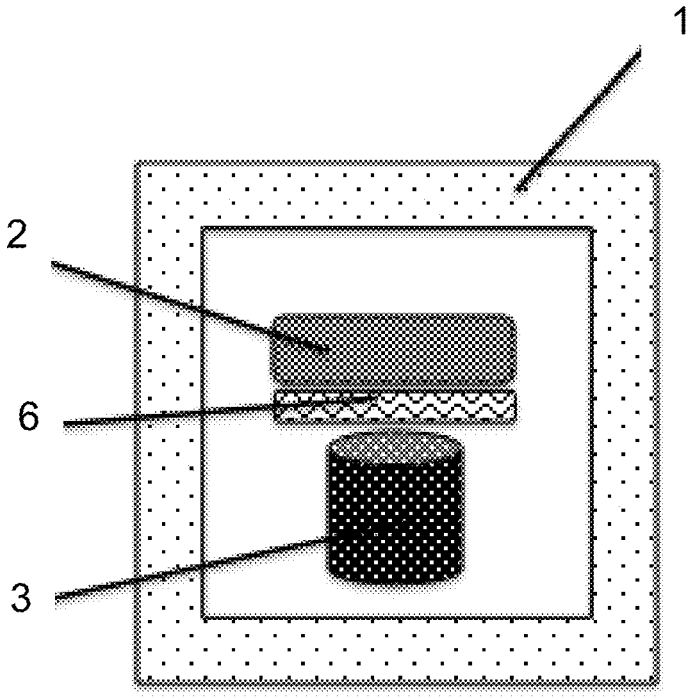
FIG. 1A (PRIOR ART)
FIGS. 1A-1B show a conventional insulated container system where (1) is an expended polystyrene insulated container, (2) is −20° C. ice pack and (3) is a vial of a medical drug.
Figure 1B:
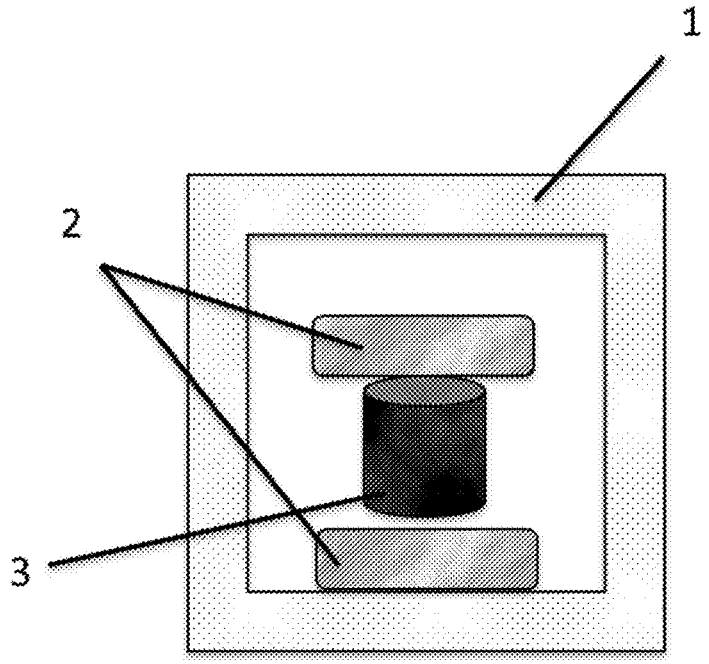
FIG. 1B (PRIOR ART)

Embodiments of the subject invention relate to a method and apparatus for thermally protecting, such as during shipping and/or storing products, so as to control the temperatures the products are exposed to. Embodiments can increase the amount of time the product and/or portions of the product experience a desired temperature range and/or reduce the amount of time the product and/or portions of the product experience temperatures outside of the desired temperature range and/or experience an undesirable temperature range. Embodiments can incorporate thermally conductive materials, such as aluminum sheet (e.g., foil), positioned around and/or near the product positioned inside a packaging container, such that the conductive materials conduct heat from one or more locations in the interior of the package to one or more other locations in the interior of the package. These thermally conductive materials can be referred to as conductive equalizers, and can act as thermal conduits, heat collectors, and/or wrapping. The conductive equalizers can have a variety of shapes and mechanical properties, such as wrapping (e.g., a conductive sheet), rigid, and/or semi-rigid. The conductive equalizers can conductively transfer heat from the hotter portions of the interior of the container to cooler portions of the interior of the container and/or from portions of the interior desired to be cooled to the cold bank. Conducting heat from hotter portions to cooler portions, or from portions to be cooled to the cold bank can result in a more uniform temperature distribution around the product. Embodiments can be permanent or temporary and can incorporate materials made completely or partially of a highly conductive material having a high thermal conductivity. Thermal banks can utilize phase change materials, ice, dry ice, gels that are made to put in the freezer. Embodiments can also be used with active cooling system to transfer heat form one position to another within an interior environment.

Specific embodiments create a direct thermal contact between the highly conductive material of the conductive equalizers and the cold bank. Such direct thermal contact can involve, for example, direct physical contact or attachment of the conductive equalizer to the cold bank via a thermally conductive material or structure. Specific embodiments create indirect thermal contact between the conductive equalizer and the cold bank so as to have sufficient heat transfer between the conductive equalizer and the cold bank to accomplish the needed heat transfer of the system. In specific embodiments, the conductive equalizer and/or thermal bank can have a sticky coating (e.g., similar to glue on a POST-IT-NOTE®, magnets, or other interconnective mechanism to help the thermal bank (e.g., gel pack or ice pack) maintain a certain proximity and/or direct contact. The conductive equalizer can be maintained in a certain position relative to the product, the container or portion of the container, the thermal bank, or other materials within the containers. The conductive equalizer can touch one, two, three, or more sides of the thermal bank to increase thermal transfer. The conductive equalizer, container walls, or other structure can incorporate a compartment to hold or position the thermal bank in place.

An embodiment of the invention can be used for shipping products in an environment that is colder than the interior of the insulated container, such as during cold weather. In this embodiment, a warmer bank can be used, such as room temperature gel packs. The heat will move from the bank toward the conductive material, having a high thermal conductivity, which reduces, or possibly prevents, the payload from losing heat to the cold surroundings.

Embodiments of the invention can use thermal conduction rather than, or in addition to, natural thermal convection, to evenly distribute the temperature inside of a container carrying a payload. Specific embodiments can incorporate one or more thermal banks, such as cold banks, room temperature banks, or warm banks. Further embodiments can utilize an insulated container to carry the payload. Embodiments can use thermal conduction by incorporating conductive equalizers made of a highly conductive material inside of the package, where the highly conductive material has a high thermal conductivity. The highly conductive material increases the surface area that is thermal conductively connected to the cold bank by, for example, at least 10%, at least 20%, at least 30%, at least 40%, at least 50%, at least 60%, at least 70%, at least 80%, at least 90% and/or at least 100%. The conductive material allows for the heat within the interior of the container to move more efficiently to the cold bank. By partially, or completely, surrounding the load with the conductive material, at least a portion of the heat from the packaging system, or container, walls and at least a portion of the heat from the convective air inside of the package will be transferred to the cold bank. Specific embodiments surround at least 10%, at least 20%, at least 30%, at least 40%, at least 50%, at least 60%, at least 70%, at least 80%, at least 90% and/or at least 100% of the load with conductive materials. Since the internal space of a packaging system typically has a low convection heat transfer coefficient due to the lack of air movement, the addition of the conductive material, and the associated conductive, surface area, increases the movement of the heat toward the cold source. By moving more heat to the cold source, the conductive material provides a more uniform temperature distribution inside the packaging system, as well as optimizing the use of the cold bank.

Increasing the surface area that is in thermal conductive contact with the cold bank, and distributing the additional surface area into regions of the interior of the container that have a different height than the cold bank, can significantly increase the temperature maintenance performance, including a more even temperature distribution, of the system. In a specific embodiment, a shipping container with an internal volume of 12 liters can have the surface area exposed to the cold bank, or the surface area in thermal conductive contact with the cold bank, increased from 0.05 $m^2$ to 0.25 $m^2$ with the addition of a conductive material positioned to surround the cold bank and payload such that 0.05 $m^2$ of the cold bank is exposed to the interior volume of the container and 0.20 $m^2$ of the conductive equalizer is exposed to the interior volume of the container. Specific embodiments have a ratio of the area of the cold bank exposed to the interior volume of the container to the area of the conductive equalizer exposed to the interior volume of the container of at least 1, at least 2, at least 3, at least 4, and/or at least 5.

Figure 2:
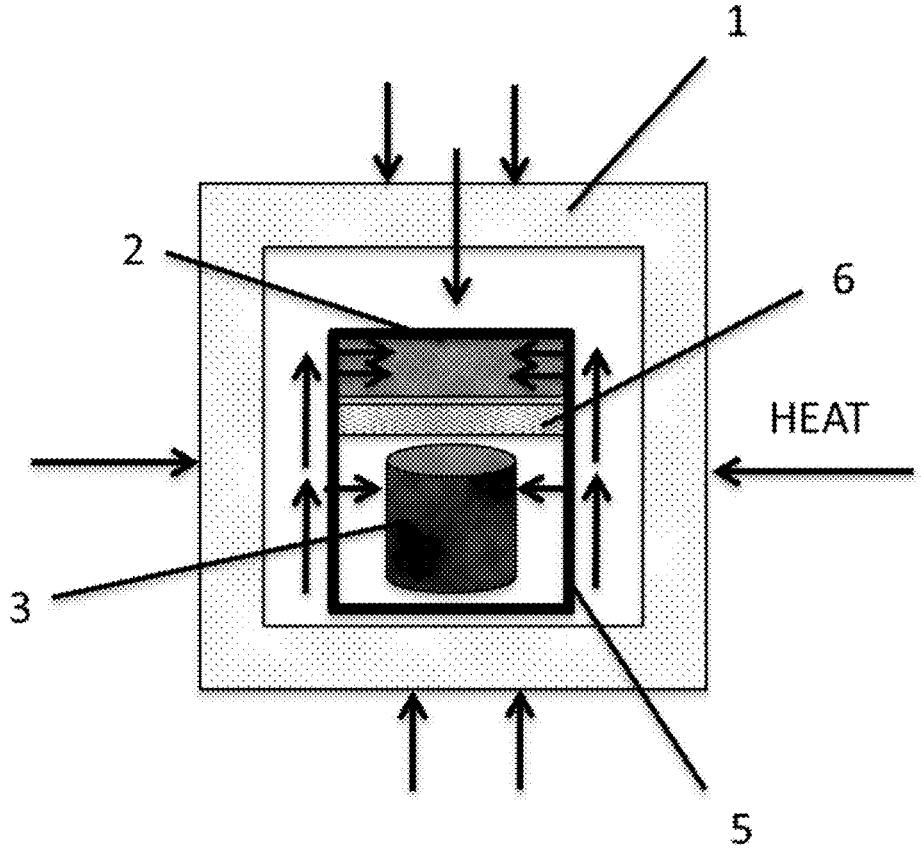
FIG. 2 shows a conductive equalizer (5) insert made of highly conductive material where (1) is an expended polystyrene insulated container, (2) is −20° C. ice pack, (6) is a room temperature gel pack and (3) is a vial of a medical drug.
Figure 3A:
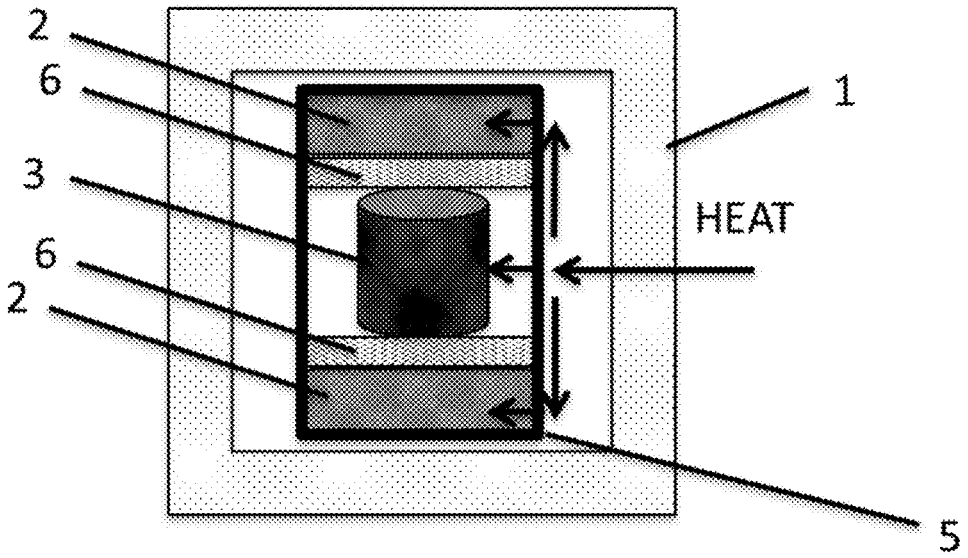
FIGS. 3A-3B show heat movement in the conductive equalizer (5) inside an insulated shipping container using two cold banks at the top and bottom in a hot external environment where (1) is an expended polystyrene insulated container, (2) is −20° C. ice pack, (6) is a room temperature gel pack and (3) is a vial of a medical drug.
Figure 3B:
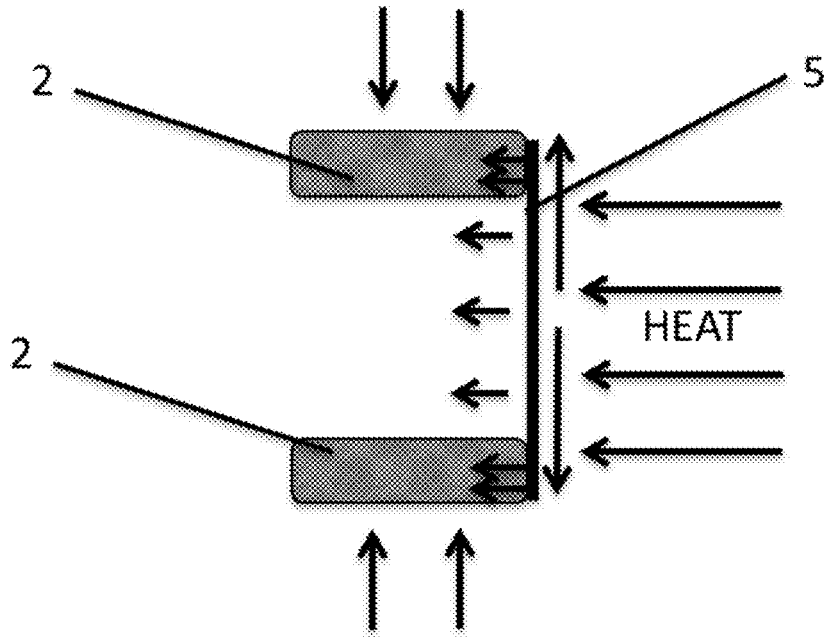

FIG. 2 shows an embodiment of the subject invention, incorporating a wrapping insert made of highly conductive material, designed for use with the container positioned in a hot external environment. FIG. 2 also shows heat transfer and heat movement with respect to the embodiment of the subject invention. FIG. 3A shows an embodiment incorporating a conductive equalizer insert made of highly conductive material and two cold banks, one cold bank at the top and one cold bank at the bottom, designed for use with the container positioned in a hot external environment. FIG. 3B shows heat transfer and heat movement with respect to the embodiment shown in FIG. 3A. FIG. 2, and FIG. 3B, represent the heat moving on the conductive material for a shipping container using one cold bank at the top, and for a shipping container using one cold bank on the top and another cold bank on the bottom, respectively. FIG. 2 also shows such heat transfer and heat movement of heat from the top, bottom, and two sides, and FIG. 3B shows the heat transfer and heat movement of heat from the top, bottom, and one side of the container, where the walls of the insulated container, the room temperature pack, and the payload are not shown, and it is assumed the opposite side had symmetrical heat transfer and heat movement.

Figure 4A:
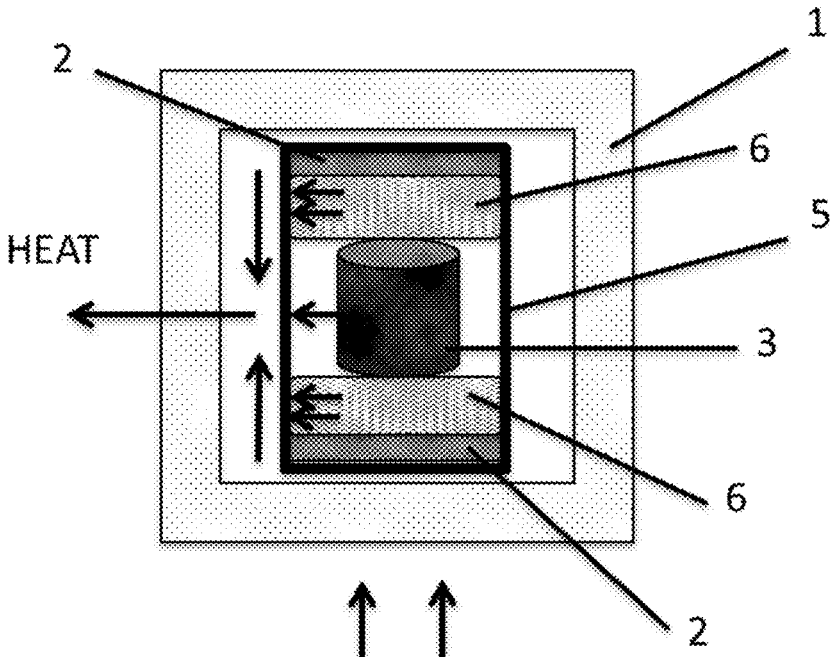
FIGS. 4A-4B show heat movement through the conductive equalizer (5) inside an insulated shipping container using two thermal banks at the top and bottom in a cold environment where (1) is an expended polystyrene insulated container, (2) is −20° C. ice pack, (6) is a room temperature gel pack and (3) is a vial of a medical drug.
Figure 4B:
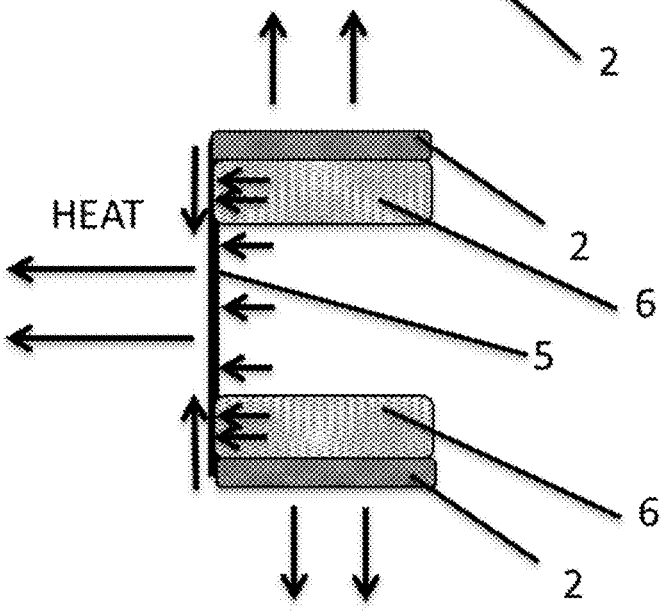

FIGS. 4A and 4B show heat transfer and heat movement for an embodiment incorporating a conductive equalizer insert and two thermal banks, one thermal bank above the payload and one thermal bank below the payload, in a cold environment. In this embodiment, the thermal banks can be cold banks or room-temperature banks. In FIG. 4B, the insulated container is not shown and the heat transfer and heat movement is shown for the top, the bottom and one side of the container, where the heat transfer and heat movement is symmetric for the other sides. Thermal conductivity is a material property in units of W/m-k. In specific embodiments, the thermal conductance of the material is high enough to accomplish the heat transfer needed to maintain the product in a desired temperature profile, where the thermal conductance is the quantity of heat that passes in unit time through a plate of an area, A, and thickness, L, in units of W·K when there is a temperature difference of one degree Kelvin, in units of $W \cdot K^{-1}$, where W is watts and $K^{-1}$ is inverse Kelvin. Materials with a higher thermal conductivity can move the heat more rapidly, thus decreasing the chances for the heat to reach the temperature sensitive product. Embodiments use materials having a thermal conductivity of at least 10 W/m-K, at least 50 W/m-K, at least 100 W/m-K, at least 150 W/m-K, and/or at least 200 W/m-K. There are many variables that can be adjusted to achieve different rates of heat transfer, or thermal conductance, toward or away from the cold bank, including, for example, the thermal conductivity of the material(s), the surface area of the conductive material(s), the thickness of the conductive material(s), and the use of conductive materials combined with insulation material(s). Examples of materials having thermal conductivities that can be utilized in embodiments of the subject invention include stainless steel (15 W/m-K), aluminum (205 W/m-K), aluminum foil (235 W/m-k), copper (400 W/m-K), and silver (429 W/m-K). Other materials can also be used.

Accordingly, for embodiments of the invention, the thermal conductance (W/K) of the conductive equalizer, from where the heat is absorbed to the cold bank can vary based on the position on the conductive equalizer that the heat is absorbed, and in particular, depends strongly on the distance traveled through the conductive equalizer from the position on the conductive equalizer that the heat is absorbed to the cold bank.

Figure 5B:
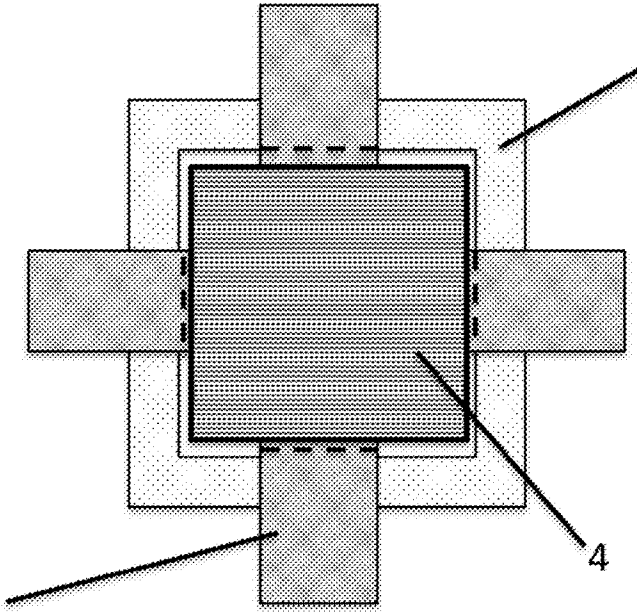
FIGS. 5A-5C show a top view of an embodiment of the subject invention (A and B) in comparison with an existing package (C) where (1) is an expended polystyrene insulated container, (5) is conductive equalizer and (4) is a payload.
Figure 5C:
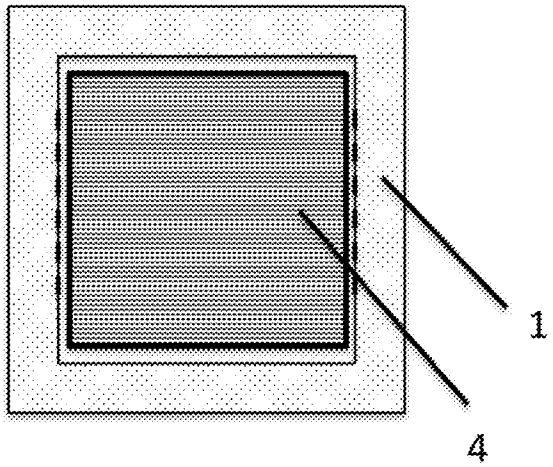
Figure 5A:
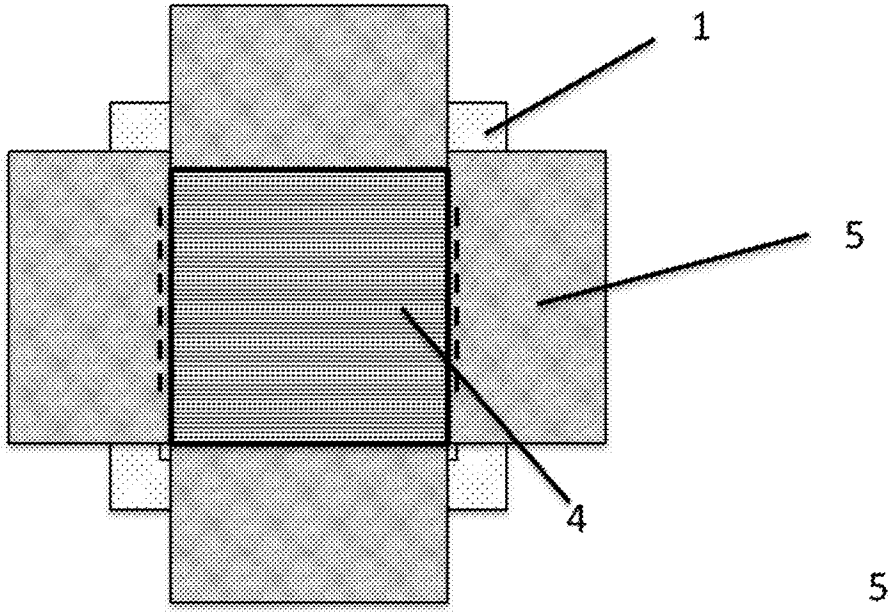
Figure 6A:
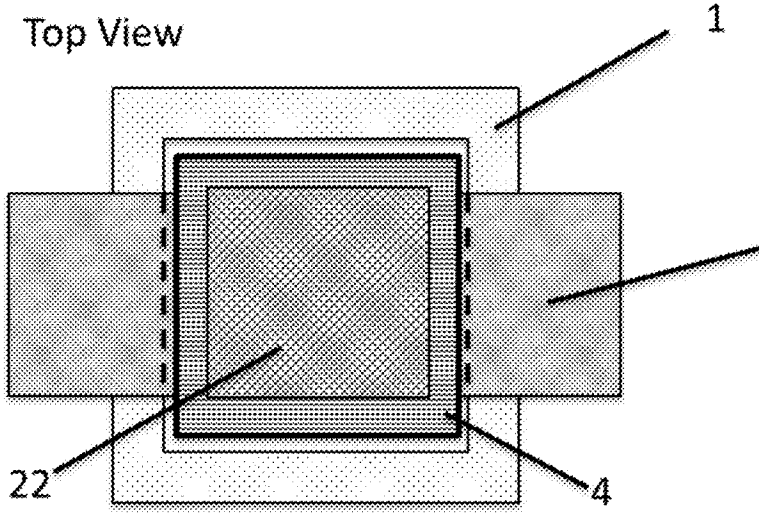
FIGS. 6A-6D show an embodiment in accordance with the subject invention where (1) is an expended polystyrene insulated container, (22) bubble wrap sheet, (5) is conductive equalizer, (4) is a payload and (2) is −20° C. ice pack.
Figure 6B:
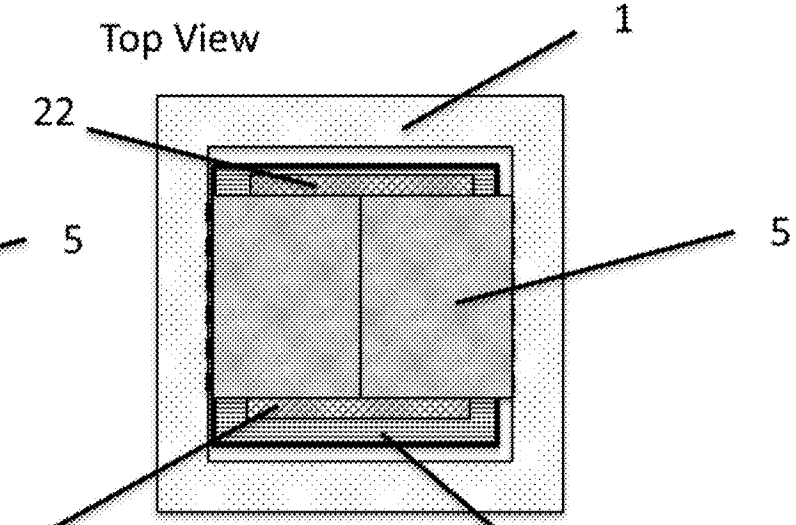
Figure 6C:
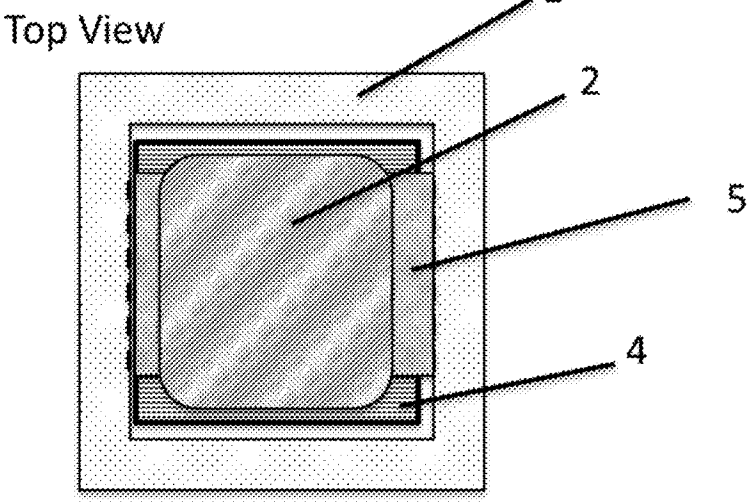
Figure 6D:
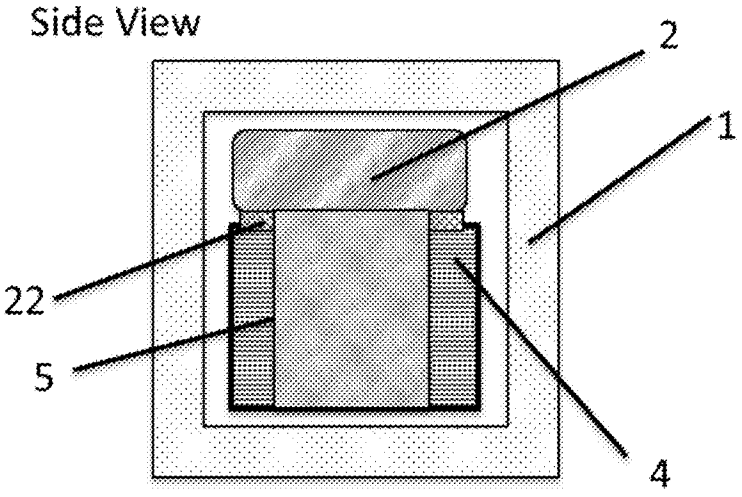

For a conductive equalizer having a sheet of material, such as in FIG. 5A, where the material of the sheet has a thermal conductivity, TC, the sheet of material has a length, L, from a proximal end of the sheet directly thermally conductively connected to the conductive equalizer to a distal end of the sheet, a thickness T, and a width w, the sheet has an effective thermal conductance from the distal end to the proximal end equal to TC×w×T/L. In a specific embodiment, L is in the range 0.05 m and 2 m. In another specific embodiment, the effective thermal conductance is at least 0.003 W/K, where W is watts and K is degrees Kelvin. In another specific embodiment, L is in the range 0.05 m and 2 m and T is greater than or equal to 0.000001 m. In another specific embodiment, L is in the range 0.05 m and 2 m and T is greater than or equal to 0.000001 m and T/L is in the range 0.0002 and 0.000005 and the effective thermal conductance is at least 0.003 W/K, where W is watts and K is degrees Kelvin. Embodiments can incorporate multiple sheets, or other extensions, that are thermally connected to the thermal bank. Embodiments can have an effective thermal conductance of at least 0.003 W/K, at least 0.004 W/K, at least 0.005 W/K, at least 0.006 W/K, at least 0.007 W/K, and/or at least 0.008 W/K.

The width and the thickness of the sheet can be varied to achieve the same effective thermal conductance. A wider sheet covers more of the surface area of the load (e.g., is positioned between the load and a portion of the interior environment of the container (not necessarily in contact) and therefore have a greater surface area for absorption of heat, but it gets harder to maintain the desired thermal conductance of the sheet as the thickness gets thinner. A thicker sheet can also be more durable. Of course, alternative shapes of extensions of the conductive equalizer can be used, and can still meet the ranges for L, w. and/or effective thermal conductance.

Specific embodiments can have a sheet extension of the conductive equalizer that also incorporates material that I non-highly thermal conductivity, where such material blocks the flow of heated fluid toward the load but does not absorb significant heat. Such material can improve the performance of the CE. Such sheet extensions, or other shape extensions, can incorporate strips of highly conductive material.

For a sheet of aluminum foil having a thickness of 16 microns since the thermal conductivity is 205 W/m-K, the thermal conductance through the sheet is 205 W/m-K*0.000016 m=0.00328 W/K (for a one meter squared piece of the aluminum foil), and if the sheet of aluminum foil having a thickness of 16 microns is 10 cm wide and 0.5 m long, then the thermal conductance from one end of the foil (e.g., where heat is absorbed) to the other end of the foil (e.g., in thermal contact with the cold bank) is 205 K/m-K*(0.000016 m*0.1 m)/0.5 m=0.000656 W/K. Of course, heat can be absorbed all over the surface area of the foil, so the thermal conductance will vary depending on the position the heat is absorbed.

Specific embodiments, for which preliminary tests were conducted, show significant improvement in the efficiency of packaging systems. Table 1 shows three different types of insulated packaging system that have been tested with and without the use of a conductive material used to increase the surface area in thermal conductive contact with the cold bank. The conductive material was aluminum foil of a thickness of 0.016 mm. Specific embodiments can have a thickness of at least 0.01 mm, at least 0.011 mm, at least 0.012 mm, at least 0.013 mm, at least 0.014 mm, at least 0.015 mm, at least 0.016 mm, at least 0.017 mm, at least 0.018 mm, at least 0.019 mm, at least 0.02 mm, at least 0.03 mm, at least 0.032 mm, less than 0.016 mm, less than 0.011 mm, and/or less than 0.2 mm. Further, the aluminum foil can be, for example, reflective, mat finish, and/or black finish, so long as the conductivity is high enough. The conductive material was wrapped around two 10 mL vials of temperature sensitive products and the cold banks. A combination of gel packs and ice packs were used in the different packaging systems.

TABLE 1

Time (h) product is maintained in the 2-8° C. range when exposed to 30° C.

| | No conductive equalizer | With conductive equalizer |
|---|---|---|
| Package System #1 | 49.5 hours | 58.5 hours |
| Package System #2 | 34 hours | 44 hours |
| Package System #3 | 59 hours | 72 hours |

The beneficial effects of a highly conductive equalizing system (aluminum conductive equalizer) can be seen in Table 2 when an insulated container using a cold bank at the top is resting on the side, which is a common occurrence during shipping.

TABLE 2

Time (h) product is maintained in the 2-8° C. range when placed on the side.

| | No conductive | equalizer | With conductive equalizer |
|---|---|---|---|
| Package | System | 22 hours | 38 hours |

The amount of surface area of the conductive material impacts the thermal efficiency of the packaging system. Table 3 compares the amount of time in the required temperature range for a packaging system without a conductive material, the packaging system with the payload fully covered in a conductive material, and the packaging system with 30% of the surface wrapped in a conductive material.

TABLE 3

Time (h) product is maintained in the 2-8° C. range when reducing the amount of surface area covered by the conductive material.

| | No conductive equalizer | 100% covered with conductive equalizer | 30% covered with conductive equalizer |
|---|---|---|---|
| Package System | 27 hours | 34 hours | 31 hours |

There are many ways to implement the use of a high thermal conductive equalizer in accordance with embodiments of the invention. The conductive equalizer can be rigid, semi-rigid or flexible. Embodiments of the invention also pertain to a conductive insert that can be incorporated with one or more existing packaging system, or can be incorporated in a packaging system during the manufacturing process of the packaging system. Applications to which embodiments of the invention can be utilized include, but are not limited to, using the highly conductive equalizer in pouch systems for mail order, insulated containers such as an ice chest, a lunch box, and/or an prescription box carrier, etc., and large insulated shipping systems such as insulated pallet load systems. The conductive material can fully or partially surround the load. A specific embodiment uses two foil bands positioned around the product such that the longitudinal axes of the foil bands are in planes that form an angle with respect to each other of at least 30°, at least 45°, at least 60°, at least 75°, and/or about 90°.

Specific embodiments of the invention utilize containers having a volume of at least 0.028 $m^3$, at least 0.056 $m^3$, at least 0.085 $m^3$, at least 0.113 $m^3$, at least 0.141 $m^3$, at least 0.283 $m^3$, at least 0.425 $m^3$, at least 0.566 $m^3$, at least 0.708 $m^3$, at least 0.850 $m^3$, at least 0.99 $m^3$, at least 1.13 $m^3$, at least 1.27 $m^3$, at least 1.42 $m^3$, at least 1.56 $m^3$, at least 1.7 $m^3$, and/or at least 1.81 $m^3$. A specific embodiment can be utilized as a pallet shipper, for shipping product on a pallet. The pallet can be approximately 1.2 m by 1.2 m and the height of the load can be approximately 1.2 m, creating a volume of approximately 1.81 $m^3$, where at least one cold bank (or warm bank) is in thermal contact with at least one thermal conduit that conductively transfers heat from (or to) portions of the interior of the package to (or from) the cold bank (or warm bank). The outer covering, surrounding the product, can be a variety of materials that provide thermal insulation between the product and cold bank (or warm bank) and the environment outside of the package. A further specific embodiment can be implemented with a cookie sheet for air cargo that is 2.4 m by 1.2 m by 1.2 m. Other sizes can also be implemented.

Specific embodiments utilize conductive equalizers with a large surface area to volume ratio, such as a metal foil. In this way, the large surface area can allow heat from the portion of the interior of the package in which the conductive equalizer is positioned to transfer heat to the conductive equalizers easily. The high thermal conductivity of the conductive equalizer material allows the heat transferred from the interior of the package to the conductive equalizers to conductively transfer heat to the cold bank, reducing the heat transferred to the temperature sensitive payload. Although much of the description is directed to cold banks and the conductive equalizers, transferring heat to the cold banks is understood that the description also applies to embodiments using warm banks where heat flow from the warm bank and through the conductive equalizers to be transferred to the portion of the interior of the package that the conductive equalizers are positioned.

Embodiments can maintain the product in a temperature range of 2-8° C., in a temperature range for frozen shipments where the cold bank utilizes liquid nitrogen, dry ice, and/or ice, and/or in a range of 0 to 30° C., for example, shipping controlled room temperature (CRT) products.

Specific embodiments can use an insulative container with a lid and one or more metal foil conductive equalizers positioned to be adjacent to the bottom of the interior of the container and running up from the bottom toward the top of the interior of the container. The container can utilize a variety of insulative materials, such as Styrofoam, polyurethane, aerogel, or VIP. The cold bank can be placed in the container either under, or preferably above, the conductive equalizers, with the product then placed on top of the cold bank, and the conductive equalizers extending above the cold bank, preferably extending to a height to where the product is, more preferably extending above the product, and even more preferably folded over the product. FIGS. 5A-5B show an embodiment where the conductive equalizers extend to a height where the product is located to a height above the product such that the conductive equalizer can fold over the top of the product (middle). The photo on the right in FIG. 5C shows the current package without the conductive equalizers. The Styrofoam lid can be put on for the embodiments in FIG. 5 to complete the package.

FIGS. 6A-6D show an embodiment of the subject invention where the conductive equalizers are placed in the container (FIG. 6A) so as to be between the bottom of the container and the product that is placed on the conductive equalizers (FIGS. 6A-6B), bubble wrap is placed on the load to prevent direct contact with the cold bank and the conductive equalizer folded over the bubble wrap sheet (FIG. 6B), and the cold bank is placed on top of the conductive equalizer (FIGS. 6C-6D), the cold bank is placed on the top so as to be in direct thermal contact with the conductive equalizer. Alternatively, the conductive equalizers can be folded over the bubble wrap and the cold bank so as to make direct thermal contact with the top of the cold bank (not shown). The lid can then be placed on the container to complete the package. The conductive equalizers are estimated to cover about 69% of the product.

Figure 7B:
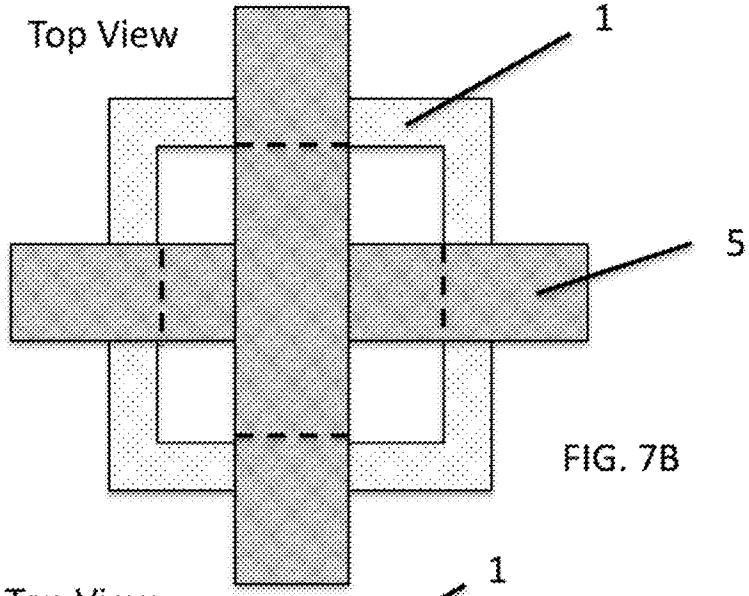
FIGS. 7A-7D show an embodiment in accordance with the subject invention where (1) is an expended polystyrene insulated container, (22) bubble wrap sheet, (5) is conductive equalizer, (4) is a payload and (2) is −20° C. ice pack.
Figure 7D:
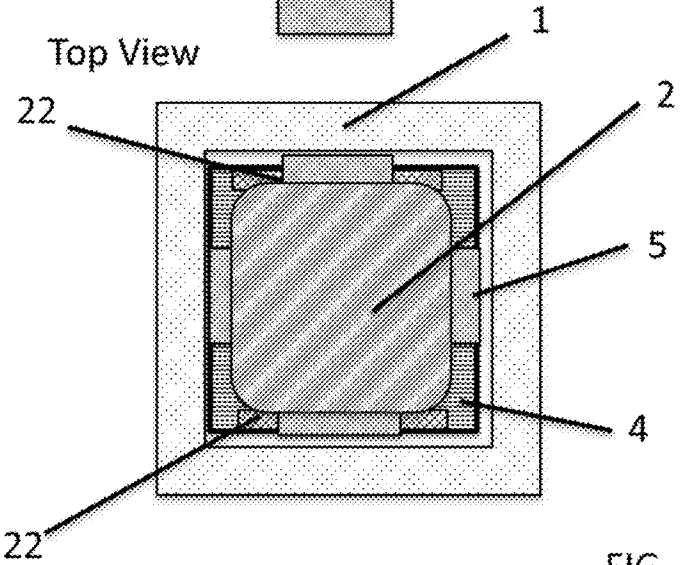
Figure 7A:
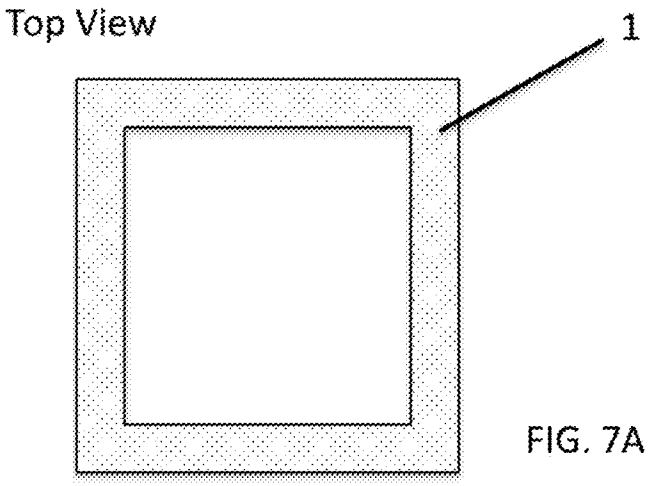
Figure 7C:
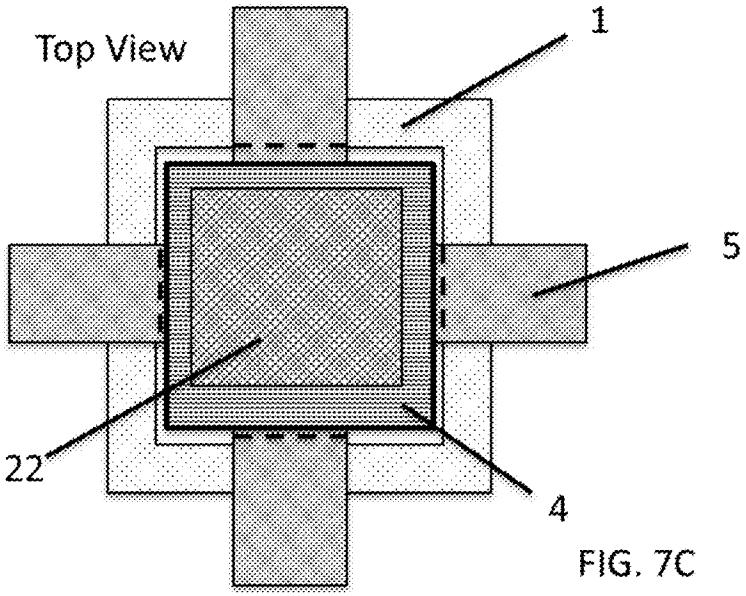

FIGS. 7A-7D show an embodiment using two conductive equalizers that are positioned to be between the product and the bottom of the Styrofoam container, extend up the side of the container to extend above the product, the bubble wrap, and the cold bank (FIGS. 7A-7C).

FIG. 7D shows that the conductive equalizers are folded over the top of the bubble wrap and product and the cold bank is placed on top of the thermal conduit so as to make direct thermal contact with the conductive equalizers. Alternatively, the cold bank could go on the bubble wrap and the thermal conduit could be folded over the cold bank and in thermal contact with the cold bank. Further alternative embodiments can have one or more of the conductive equalizers go under the cold bank and one or more of the conductive equalizers go over the cold bank.

Further embodiments can have conductive equalizers attached to the bottom and sides of the container, or portions of the bottom and sides of the container. Such an embodiment can make direct thermal contact between the cold bank and the conductive equalizers by placing the cold bank in the bottom of the container. The top can optionally have material with high thermal conductivity, such as metal foil. If the cold bank is to thermally contact the material with high thermal conductivity on top of the container, there can be a mechanism for the material with high thermal conductivity on the top to be in direct thermal contact with the cold bank and a mechanism to thermally contact the conductive equalizers to the top highly conductive material (such as the closing of the lid makes such contact). Other variations exist, such as an insert that lines the container and acts as the thermal conduit.

Embodiments of the invention employ mechanisms based on the principles of heat transfer, mainly by conduction and convection.

Some payload products need to be maintained in a specific temperature range due to regulations and to preserve their quality. During the transportation of these payload products they are usually placed in an insulated container that can range in volume from 0.014 $m^3$ to 3.4 $m^3$. In the case where the outside environment has a different temperature than the product temperature, the use of a cold bank (such as ice, ice pack, dry ice, etc.) is commonly used. The cold bank is designed to absorb the heat that is coming from the walls of the container before it reaches the products inside the container. However, very often the heat will reach the payload before the cold bank can absorb it. Most containers have low heat transfer rates by conduction because filling materials, such as bubble wrap, paper, or air bags are used between the insulation and the payload.

Embodiments of the invention aims to capture (absorb) the heat penetrating the container from the outside and transfer such heat to the cold bank before such heat reaches the payload, which needs to be maintained at a specific temperature or in a specific temperature range. In order to absorb the heat penetrating the container from outside and transfer the heat to the cold bank, one or more heat collectors can be placed between the walls and the payload, where the heat collectors will absorb and move the heat away from the payload and transfer the heat to the cold bank. The quality of the network of conductive equalizers will be measured by the ability of the network of conductive equalizers to reduce the heat intake by the payload, reduce the temperature variation in the payload, minimized the hot and cold spots, and optimize the use of the cold bank.

Embodiments of the invention can utilize a conductive equalizer system that uses components made of conductive materials. The system can use single or multiple materials that will provide protection to the payload by moving the heat away from the payload toward the cold bank.

The heat coming from the walls is captured by the conductive equalizer system through conduction (if touching directly the walls), by convection (if there is a gap between the walls and the collector) or by radiation (if the walls are emitting heat). Usually heat from radiation is minimal and does not contribute significantly to the heat intake by the payload. However heat from conduction and convection can be significant. A primary feature of embodiments of the subject conductive equalizer system is the surface area of the heat collector exposed. It is possible to increase the rate of heat transfer by increasing the surface area of the conductive equalizer system. Once the heat is captured by the system the heat is transferred to the cold bank by conduction. It is important that the conductive equalizer system is made of highly conductive materials that will conduct the heat through the heat collector system to the cold bank as fast as possible. The speed and the amount of heat moving through the conductive equalizer system will depend on the thermal conductivity of the materials making the system as well as the cross-section area of the conductive equalizer system (usually referred as thickness).

An example of a basic heat collector system would be a highly conductive material (such as aluminum or copper) that covers the whole surface exposed by the products (load) where at least one section is connected to a cold bank (like ice, dry ice, gel ice, or ice pack). In this way, any heat penetrating the insulated container would be captured by the conductive equalizer system and carried to the cold bank before it reaches the products (load). The surface area of the conductive equalizer system may be adjusted depending on the thermal conductivity of the materials making it. In specific embodiments, the conductive equalizer does not cover the whole surface of the products (load), and, in other embodiments the surface of the conductive equalizer system is increased by using ripples or fins to increase the effective surface area.

Figure 10A:
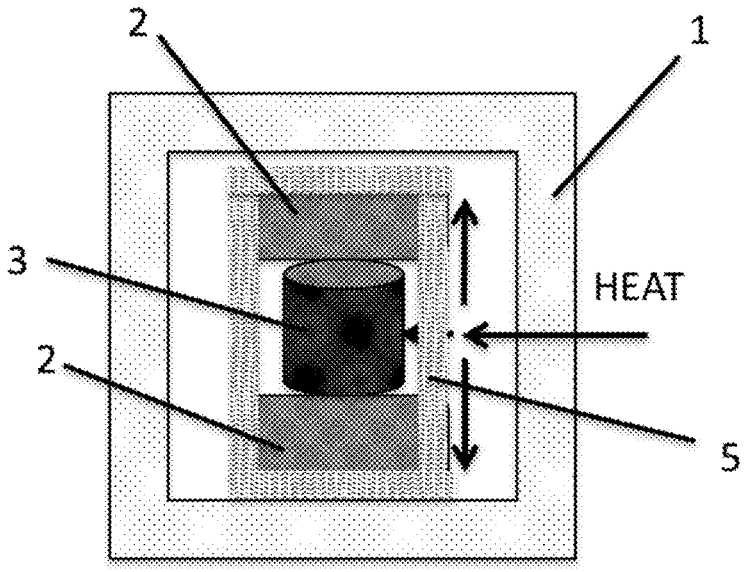
FIGS. 10A and 10B show heat movement in a wavy shaped conductive equalizer (5) inside an insulated shipping container using two cold banks at the top and bottom in a hot external environment where (1) is an expended polystyrene insulated container, (2) is −20° C. ice pack and (3) is a vial of a medical drug.
Figure 10B:
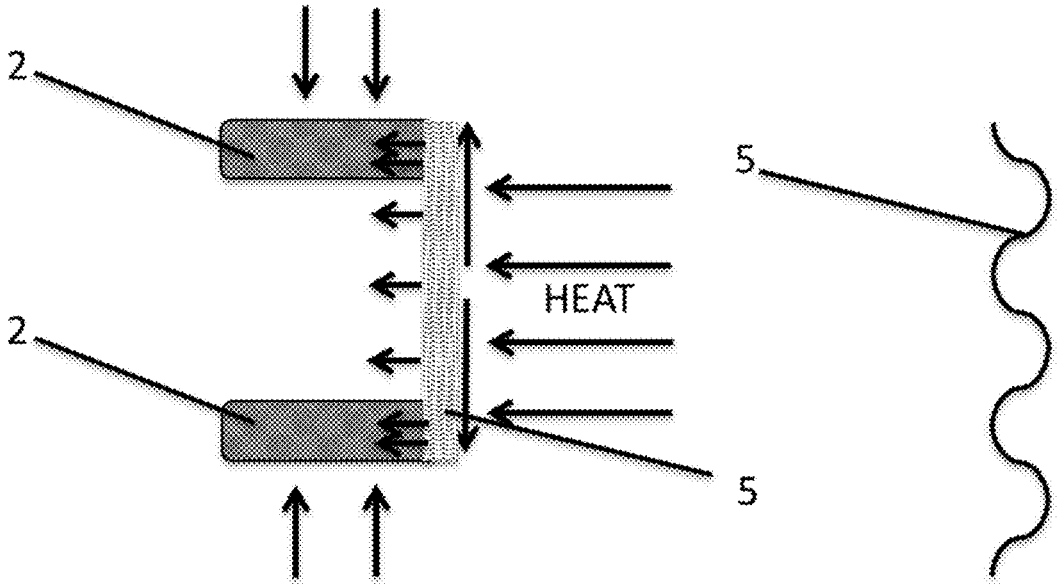
Figure 11:
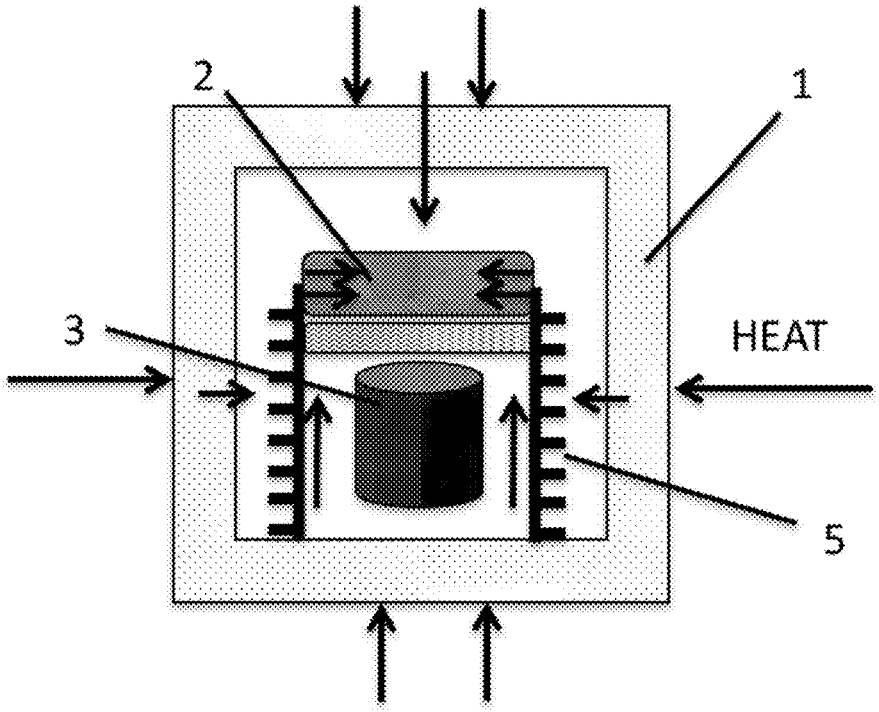
FIG. 11 shows heat movement in a fin shaped conductive equalizer system (5) inside an insulated shipping container using two cold banks at the top and bottom in a hot external environment where (1) is an expended polystyrene insulated container, (2) is −20° C. ice pack and (3) is a vial of a medical drug.
Figure 12:
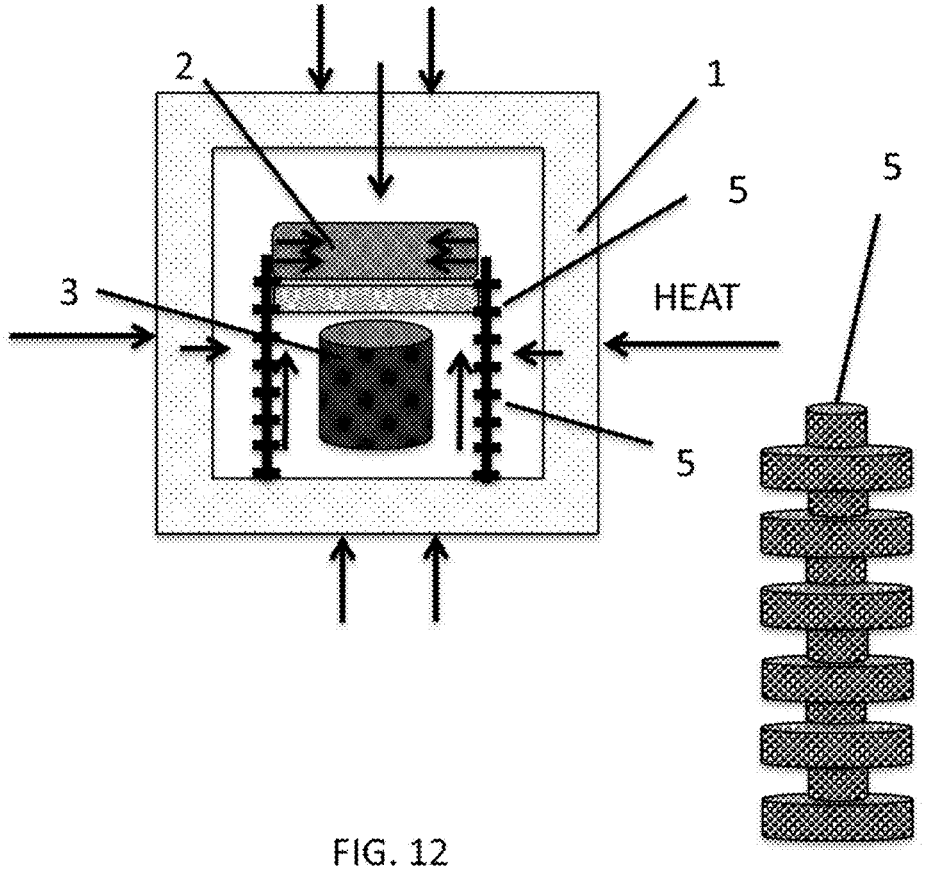
FIG. 12 shows heat movement in a rod type conductive equalizer system (5) inside an insulated shipping container using two cold banks at the top and bottom in a hot external environment where (1) is an expended polystyrene insulated container, (2) is −20° C. ice pack and (3) is a vial of a medical drug.

The thermal conductive equalizer can be designed as a simple plate (sheet) (FIG. 2A), a wavy sheet (FIGS. 10A-10B) or a very complex network of fins connected to rods or plates (FIGS. 11 and 12). In FIG. 12 the thermal conductive equalizer system can be made of one material or a combination of multiple materials such as aluminum fins and copper rod.

Example 1

Optimizing the Use of the Cold Bank

A 0.028 $m^3$, 25.4 mm thick EPS container with a 0.68 kg ice pack conditioned at −20° C. was used for this test. Three insulated packaging systems were tested using the regular configuration against an embodiment of the invention that involves wrapping the payload and the cold bank (two 10 ml vials, one 0.68 kg ice pack at the top) with an aluminum conductive equalizer sheet of a thickness of 0.016 mm that covered 100% of the surface area of the payload and one with an aluminum conductive equalizer sheet with a thickness of 0.016 mm that covered 30% of the surface area of the payload. Reducing the surface area can also play an important role in the thermal efficiency of the conductive material covering system. As it can be seen in Table 4 below, a conventional insulated container using a cold bank at the top can be improved by using a 30% total surface aluminum conductive equalizer sheet but be further optimized with a more significant gain by having 100% surface coverage.

TABLE 4

| Time (h) product is maintained in the 2-8° C. range when using partial surface wrapping system. | | |
|---|---|---|
| No conductive Equalizer | 100% surface conductive equalizer | 30% surface conductive equalizer |
| 27 hours | 34 hours | 31 hours |

In specific embodiments the outside surface area of the conductive equalizer system is at least 10%, at least 20%, at least 30%, at least 40%, at least 50%, at least 60%, at least 70%, at least 80%, at least 90%, and/or 100% of the outside surface area of the payload (products). In a specific embodiment, the outside surface area is at least 20% of the outside surface area of the payloads.

Example 2

Reducing the Temperature Differences Inside the Load

- Insulated container: EPS 38 mm wall with outside dimensions 292 mm×228 mm×336 mm
- Load: 127 mm×178 mm×203 mm (with 7 prefilled syringes (2 ml each) and 4 vials (5 ml each)) conditioned at 24° C.
- Cold bank: 0.45 kg ice pack (2) conditioned at −20° C. placed on the top
- Conductive equalizer system: 127 mm×178 mm×203 mm (outside layer like a box)
- Conductive equalizer materials
  - A. LDPE film 0.05 mm thickness (thermal conductivity: 0.33 W/(m-K)
  - B. Mylar reflective film 0.05 mm thickness (thermal conductivity: 0.15 W/(m-K)

C. Aluminum sheet 0.016 mm thickness (thermal conductivity: 205 W/(m-K)
D. Aluminum sheet 0.3 mm thickness (thermal conductivity: 205 W/(m-K)
E. Steel sheet 0.3 mm thickness (thermal conductivity: 43 W/(m-K)
F. Copper sheet 0.3 mm thickness (thermal conductivity: 401 W/(m-K)

Figure 8:
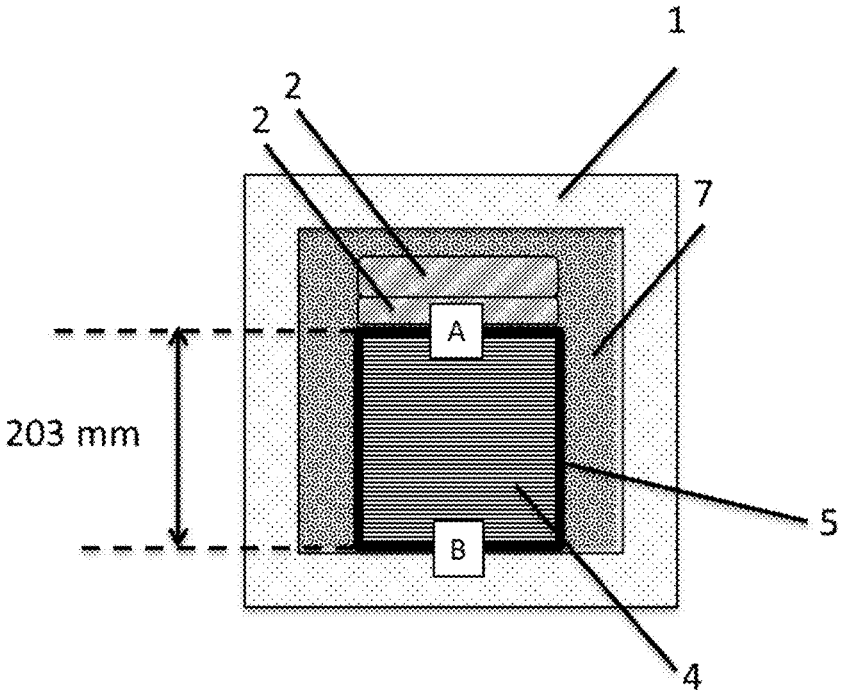
FIG. 8 shows an embodiment in accordance with the subject invention where (1) is an expended polystyrene insulated container, (5) is conductive equalizer, (4) is a payload, (2) is −20° C. ice pack and (7) is bubble filling wrap. The number [A] and [B] are representing the closest and the farthest points from the cold bank.

Filling material in free space: bubble wrap LDPE (FIG. 8)

Results

| Conductive equalizer type | location 1 | location 2 | Temperature difference |
|---|---|---|---|
| A | 6.6 | 14.9 | 8.3 |
| B | 7.9 | 14.1 | 6.2 |
| C | 6.2 | 11.1 | 4.9 |
| D | 4.3 | 7.5 | 3.2 |
| E | 5.5 | 10.5 | 5.0 |
| F | 4.3 | 5.6 | 1.3 |

In specific embodiments, the combined thermal conductivity of the heat collector materials is at least 40 W/(m-K). In further embodiments, the combined thermal conductivity of the conductive equalizer materials is at least 30 W/(m-K), at least 50 W/(m-K), and/or at least 60 W/(m-K).

In specific embodiments, the thickness of the conductive equalizer system sheet multiplied by its combined thermal conductivity is at least 0.00328 W/m where 205 W/(m-K) *0.000016 m=0.00328 W/K. In further embodiments, the thickness of the conductive equalizer system sheet multiplied by its combined thermal conductivity is at least 0.00300 W/K, at least 0.00400 W/K, and/or at least 0.00350 W/K.

Example 3

Reducing the Temperature Differences Inside the Load

Insulated container: EPS 25.4 mm wall with outside dimensions 203 mm×203 mm×203 mm Load: 152 mm×152 mm×76 mm (4 vials (5 ml each)) conditioned at 24° C.

Cold bank: 0.45 kg ice pack conditioned at −20° C. placed on the top

Conductive equalizer system: 152 mm×152 mm×76 mm (outside layer like a box)

Conductive equalizer materials

A. LDPE film 0.05 mm thickness (thermal conductivity: 0.33 W/(m·K)
B. Aluminum sheet 0.3 mm thickness (thermal conductivity: 205 W/(m·K)
C. Copper sheet 0.3 mm thickness (thermal conductivity: 401 W/(m·K)

Figure 9:
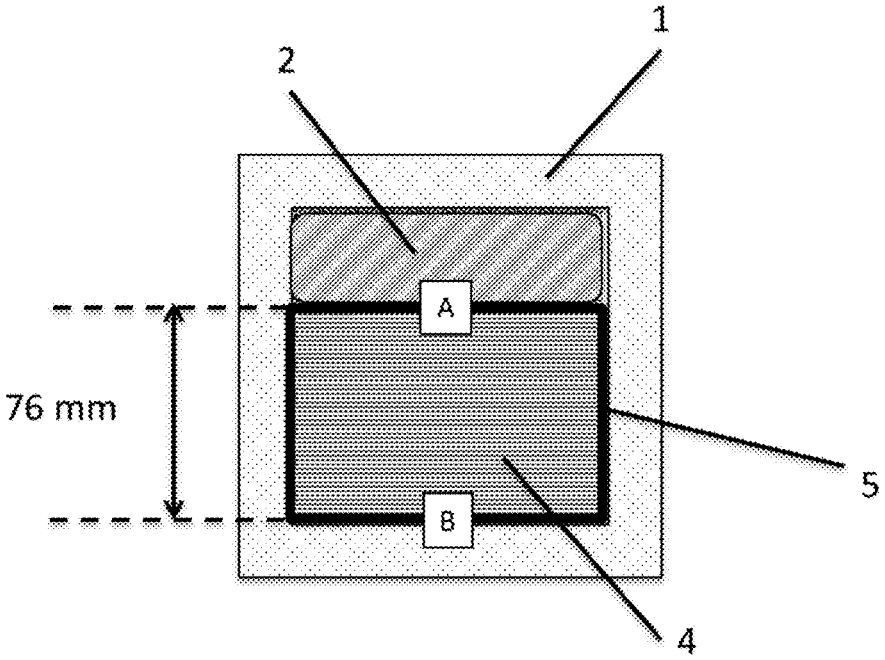
FIG. 9 shows an embodiment in accordance with the subject invention where (1) is an expended polystyrene insulated container, (5) is conductive equalizer, (4) is a payload and (2) is −20° C. ice pack. The number [A] and [B] are representing the closest and the farthest points from the cold bank.

Filling material in free space: bubble wrap LDPE (FIG. 9)

Results

| Conductive equalizer type | location 1 | location 2 | Temperature difference |
|---|---|---|---|
| A | 6.3 | 10.5 | 4.2 |
| B | 7.1 | 10.0 | 2.9 |
| C | 6.4 | 9.9 | 2.5 |

In a specific embodiment, the cold bank is at least 70 mm away from the furthest point in the payload. In further embodiments, the cold bank is at least 50 mm, at least 60 mm, at least 80 mm, and/or at least 90 mm away from the furthest point in the payload.

Payload Uses

Payloads that would benefit from embodiments of this invention include, but are not limited to any payload that has to maintain a specific temperature such as, perishable foods, produce, pharmaceutical drugs, biopharmaceuticals, biologics, blood products, and test specimens.

Other Applications

The conductive material can be used in a variety of different sizes and applications. The material itself can be varied such as:

Mesh, made out of a conductive material such as copper or aluminum
Strips of conductive materials such as copper or aluminum
Rods made out of a conductive material such as copper or aluminum
Fin system made out of a conductive material such as copper or aluminum
The conductive materials can be combined
Ribbed
Wavy
Alloy's can be used if they are conductive Temperature Ranges Temperature sensitive payload products can be transported in this system. A few temperature ranges the products must be maintained within include:

1.5-8.5° C.
25-0° C.
8.5-15.5° C.
19.5-25.5° C.
0-30° C.
14.5-35.5° C.
0-5° C.
10-13° C.

Figure 13:
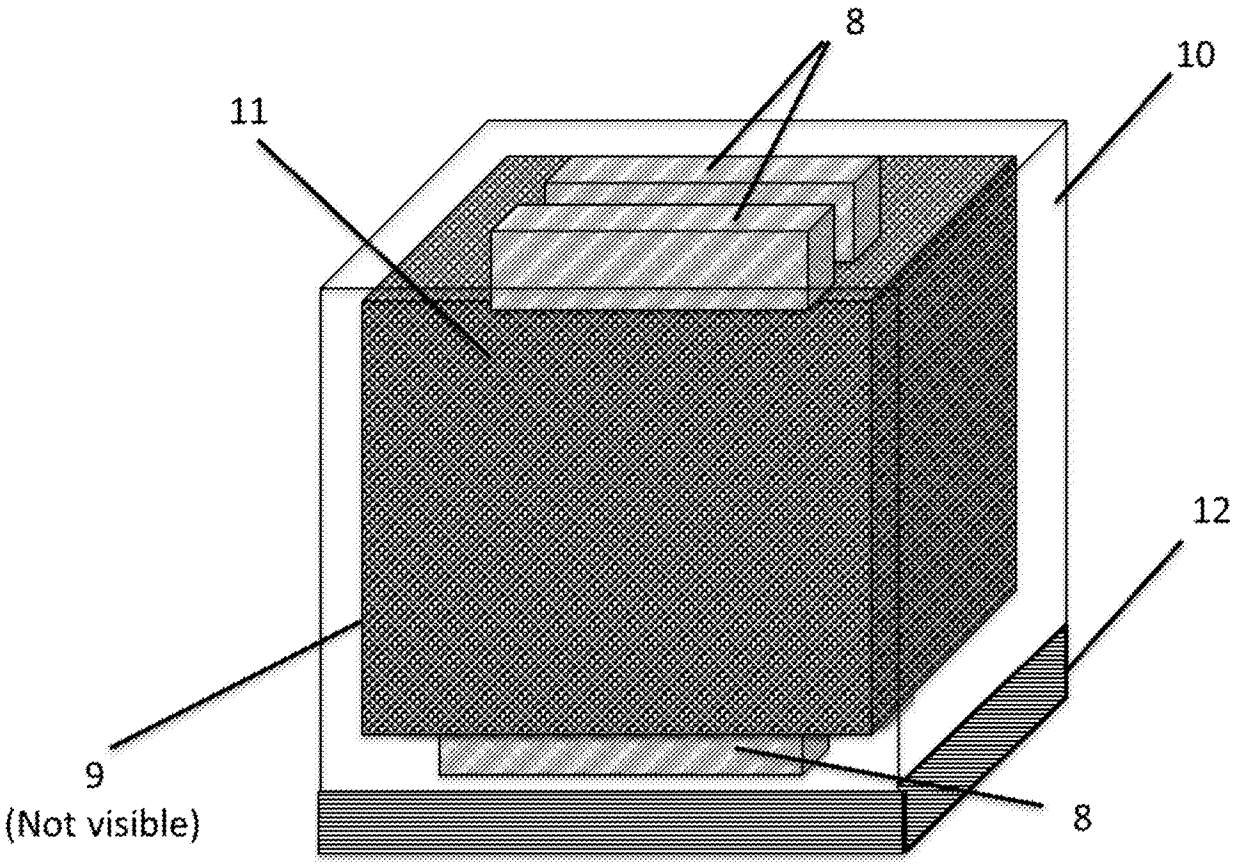
FIG. 13 shows an embodiment in accordance with the subject invention for a pallet shipper where (10) is an insulated pallet cover (outer dimensions 1.2 m×1 m×1.2 m), (11) is conductive equalizer made of aluminum sheets 0.0003 m thick (outer dimensions 1.1 m×0.9 m×1 m), (9) is a load (not visible) (outer dimensions 1 m×0.8 m×0.9 m), (8) is a −20° C. ice brick (10 kg), and (12) is a standard US pallet (dimensions 1.2 m×1 m×0.15 m).

Modes of Transportation With Respect to Which Embodiments of the Subject can be Utilized Include Refrigerated trailer
Non-refrigerated trailer
Refrigerated sea container
Non-Refrigerated sea container
Passive air ship container
Active air ship containers
Third party parcel carriers, such as FedEx, UPS, USPS
Third party freight carriers, such as FedEx, UPS, USPS
Freight forwarders
Temporary storage in a non-refrigerated warehouse
Temporary storage in a refrigerated warehouse A Variety of Structures can be Used for Positioning Conductive Material, Including, but not Limited to, the Following Wrapped around payload fully or in part
Lining the inside of the insulation material
On top of the cold source
Under the cold source
On the corners of the insulation
On the corners of the payload
On the top of the payload
On the bottom of the payload
On the side or sides of the payload
On top and bottom with connecting pieces
In an pattern, such as an 'X"
Any combination of the above Below are a few EXAMPLES to show to variations of the invention, not to necessarily limit to these specific parameters A pallet shipper using a conductive equalizer made of Aluminum sheet (0.0003 m thickness), as shown in FIG. 13.

Figure 14:
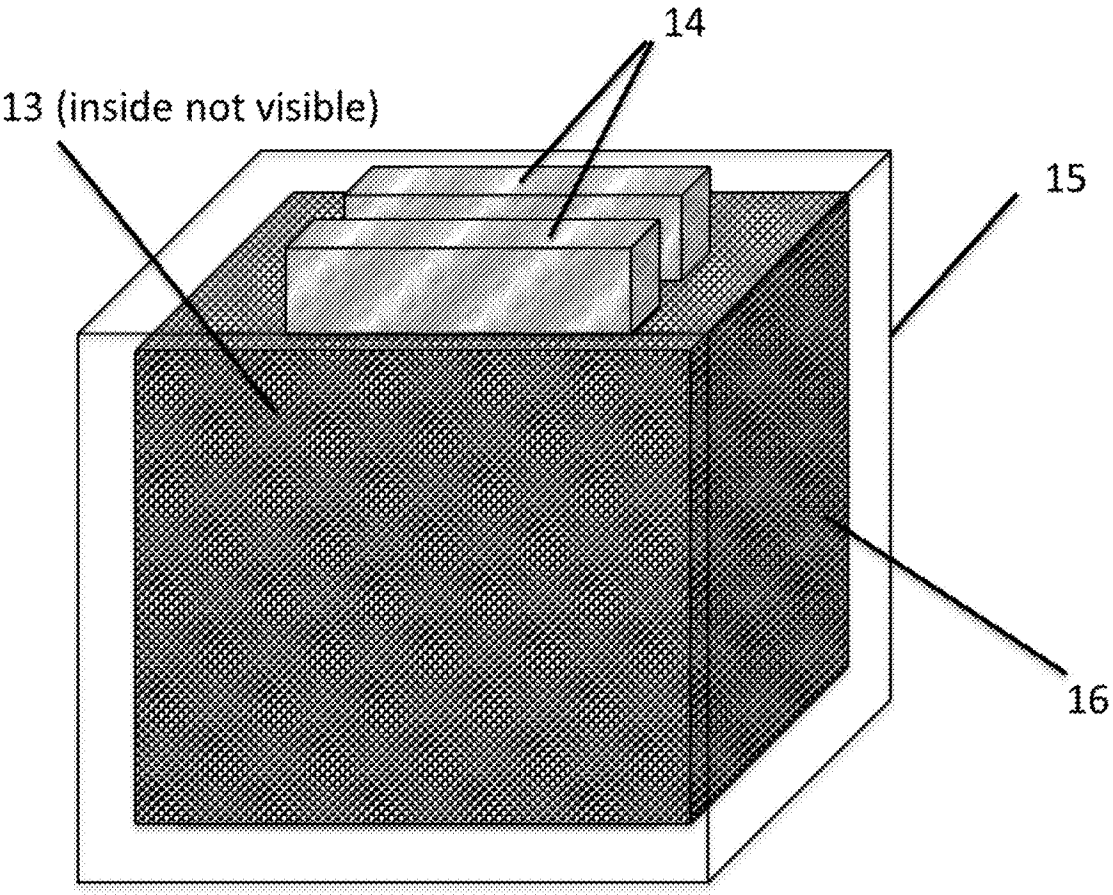
FIG. 14 shows an embodiment in accordance with the subject invention for a shipping container where (15) is an insulated EPS container (outer dimensions 0.5 m×0.5 m×0.5 m and wall thickness 0.05 m), (16) is conductive equalizer made of aluminum mesh sheets (outer dimensions 0.31 m×0.31 m×0.31 m), (13) is a load (not visible) (outer dimensions 0.3 m×0.3 m×0.3 m) and (14) is a −20° C. ice brick (2.5 kg).

An EPS container using a conductive equalizer made of a mesh aluminum sheet, as shown in FIG. 14.

Figure 15:
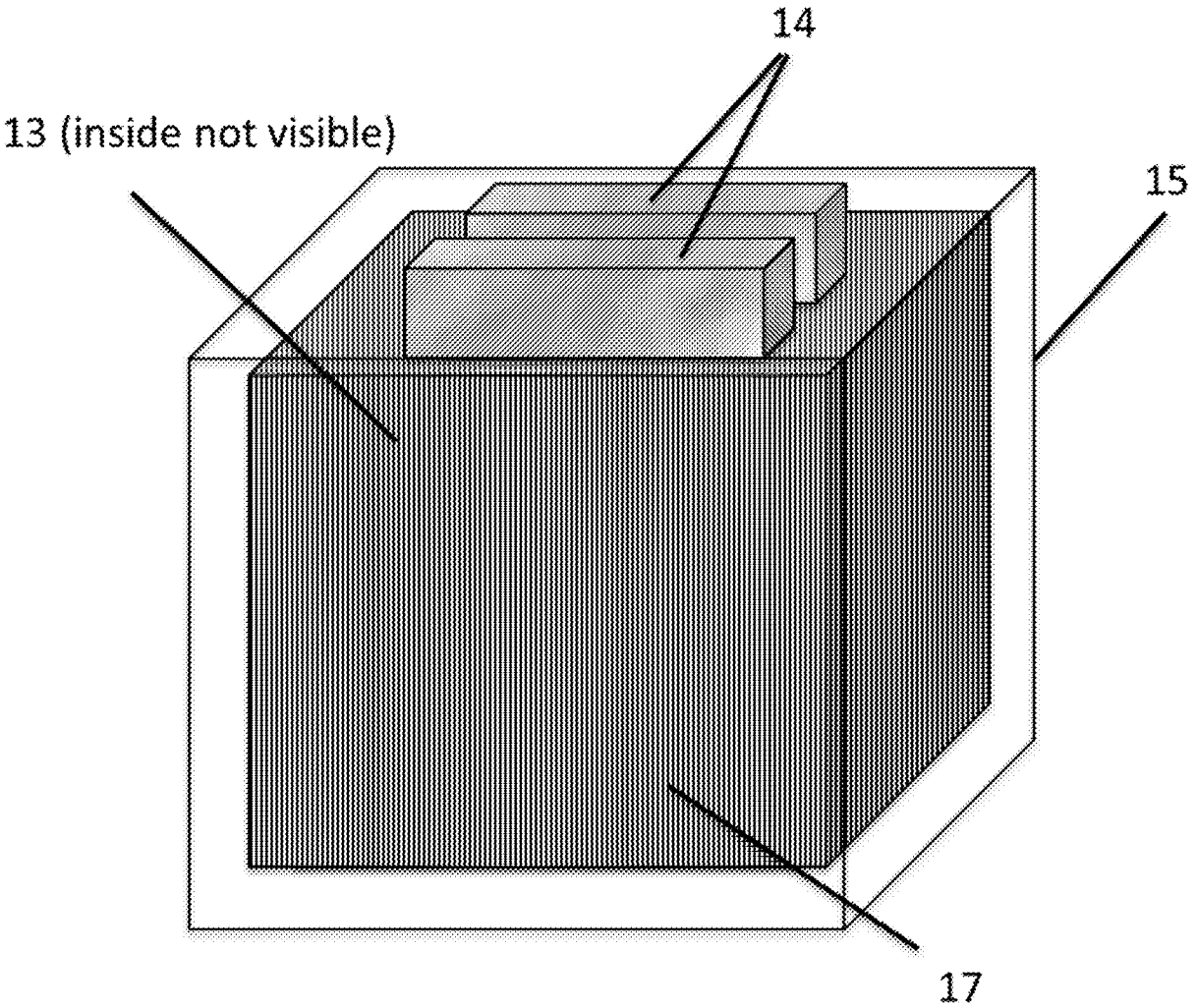
FIG. 15 shows an embodiment in accordance with the subject invention for a shipping container where (15) is an insulated EPS container (outer dimensions 0.5 m×0.5 m×0.5 m and wall thickness of 0.05 m), (17) is conductive equalizer made of 0.01 m copper strips on a Mylar sheet (outer dimensions 0.31 m×0.31 m×0.31 m), (13) is a load (not visible) (outer dimensions 0.3 m×0.3 m×0.3 m) and (14) is a −20° C. ice brick (2.5 kg).

An EPS container using a conductive equalizer made of multiple 0.01 m copper strips on a Mylar sheet, as shown in FIG. 15.

Figure 16:
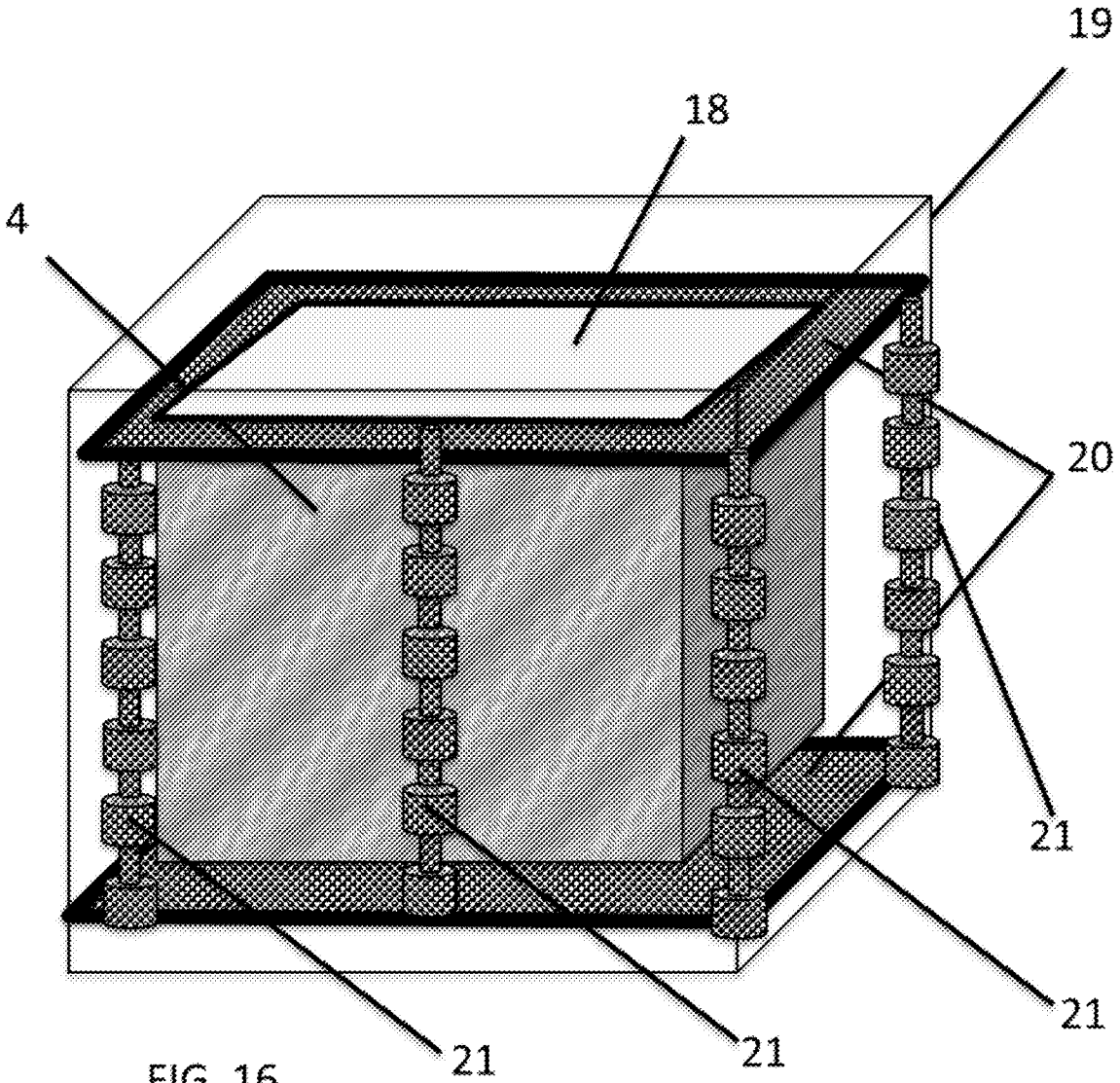
FIG. 16 shows an embodiment in accordance with the subject invention for a shipping container where (19) is an insulated EPS container (outer dimensions of 1 m×1 m×1 m and 0.1 m wall thickness), (20) is part 1 of a conductive equalizer system made of aluminum sheet (1 mm thick), (21) is part 2 of a conductive equalizer system made of copper rod (0.01 in diameter) and aluminum fins (0.25 mm in diameter), (4) is a payload and (18) is a dry ice block (10 kg).

A large EPS container carrying frozen blood products (with dry ice block) using a conductive equalizer system made of two aluminum sheets 0.01 m thick and a network of copper rods (0.01 m diameter) with aluminum fins (0.025 m diameter), as shown in FIG. 16.

Figure 17:
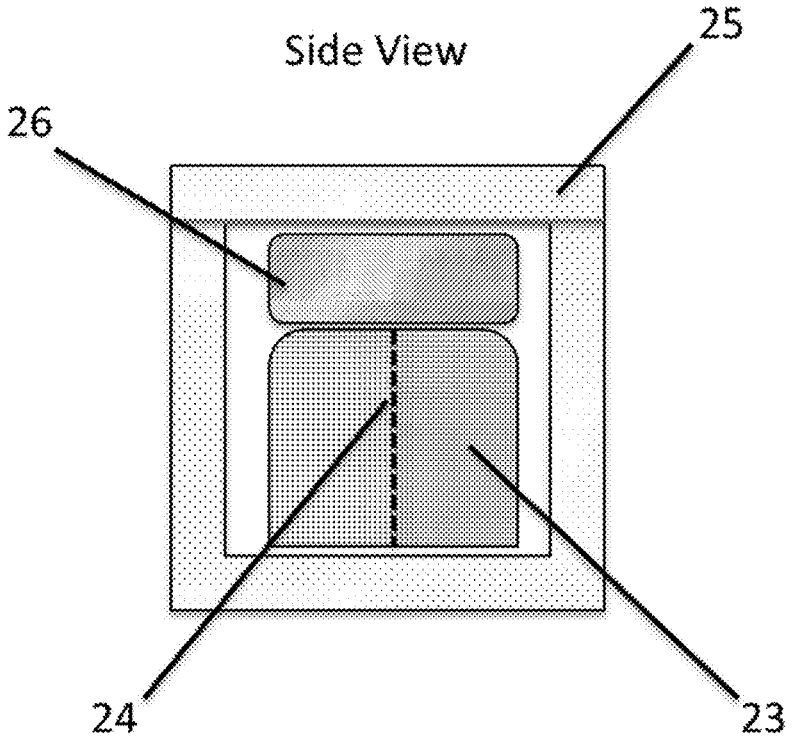
FIG. 17 shows a side view of an embodiment in accordance with the subject invention for a shipping container where (23) is a conductive equalizer incorporating a flexible plastic pouch with copper strips 0.01 m wide, (25) is a styrofoam cooler (outer dimensions 12"×12"×12" and walls 0.05 m (2") thick), (24) zipper, and (26) is a dry ice block (1 kg).

FIG. 17 shows a side view of an embodiment in accordance with the subject invention for a shipping container where (23) is a conductive equalizer incorporating a flexible plastic pouch with copper strips 0.01 m wide, (25) is a styrofoam cooler (outer dimensions 12"×12"×12" and walls 0.05 m (2") thick), (24) zipper, and (26) is a dry ice block (1 kg). Specifically, the outer dimensions of the cooler is 12"×12"×12" with the lid on, and the internal volume enclosed by the cooler is 8"×8"×8".

Figure 18:
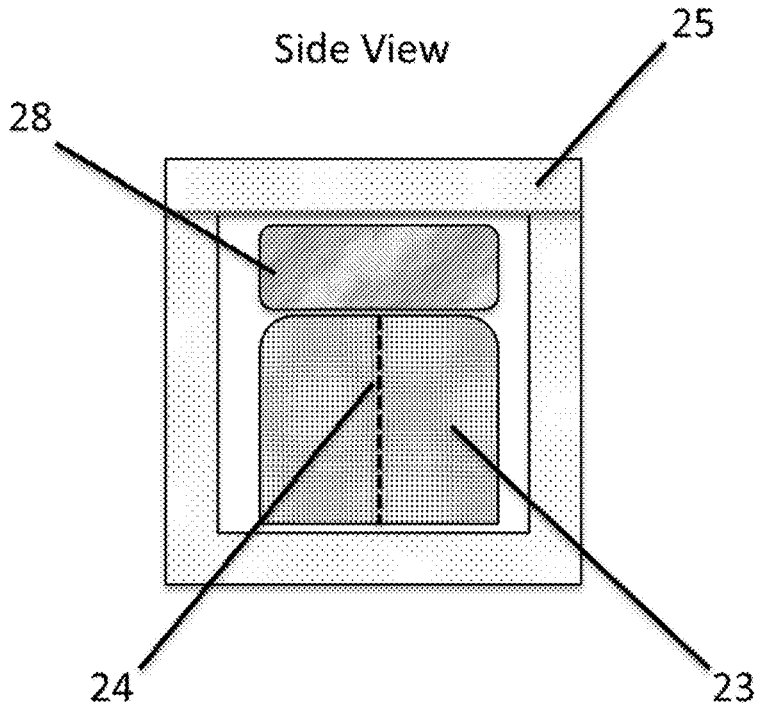
FIG. 18 shows a side view of an embodiment in accordance with the subject invention for a shipping container where (23) is a conductive equalizer incorporating a flexible plastic pouch with copper strips 0.01 m wide and spaced 0.01 m apart, (24) zipper, (25) is a styrofoam cooler (outer dimensions 12"×12"×12" and walls 0.05 m (2") thick), and (28) is a hot gel pack (1 kg).

FIG. 18 shows a side view of an embodiment in accordance with the subject invention for a shipping container where (23) is a conductive equalizer incorporating a flexible plastic pouch with copper strips 0.01 m wide and spaced 0.01 m apart, (24) zipper, (25) is a styrofoam cooler (outer dimensions 12"×12"×12" and walls 0.05 m (2") thick), and (28) is a hot gel pack (1 kg). This embodiment uses the same cooler as in FIG. 17.

Figure 19:
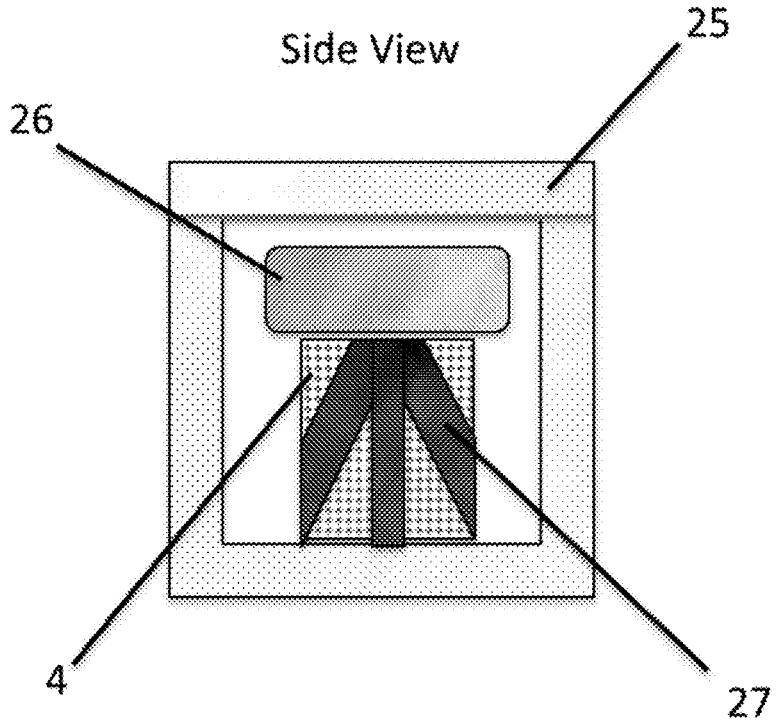
FIG. 19 shows a side view of an embodiment in accordance with the subject invention for a shipping container where (27) is a conductive equalizer incorporating flexible plastic tape with copper coating 0.03 m wide, (25) is a styrofoam cooler (outer dimensions 12"×12"×12" and walls 0.05 m (2") thick), and (26) is an ice brick (1 kg).

FIG. 19 shows a side view of an embodiment in accordance with the subject invention for a shipping container where (27) is a conductive equalizer incorporating flexible plastic tape with copper coating 0.03 m wide, (25) is a styrofoam cooler (outer dimensions 12"×12"×12" and walls 0.05 m (2") thick), and (26) is an ice brick (1 kg). This embodiment uses the same cooler as in FIG. 17.

EMBODIMENTS

Embodiment 1. An apparatus for thermally protecting a load, comprising:

a container, wherein the container is configured to position a load within an interior of the container;

a thermal bank, wherein the thermal bank is configured to absorb heat from a source above an operating temperature of the thermal bank;

a conductive equalizer, wherein the load is positioned within a container, wherein at least a portion of the conductive equalizer has a thermal conductivity of at least 10 W/mK;

direct thermal conductively connecting the conductive equalizer to the thermal bank, wherein the thermal bank can absorb heat from the conductive equalizer or provide heat to the conductive equalizer, wherein when the conductive equalizer is positioned proximate the load, the period of time the load is maintained in a desired temperature range is extended.

Embodiment 2. The apparatus according to any preceding embodiment, wherein the conductive equalizer comprises a material or multiple materials that allow heat to move from a first position in an interior of the container that has a high temperature to a second position in the interior of the container that has a lower temperature.

Embodiment 3. The apparatus according to any preceding embodiment, wherein the conductive equalizer extends the period of time the payload is maintained in a desired temperature range by conducting heat from the location the conductive equalizer is positioned to the thermal bank.

Embodiment 4. The apparatus according to any preceding embodiment, wherein the conductive equalizer comprises at least one part comprising one or more materials having a thermal conductivity in the range from 10 to 500 W/m-K.

Embodiment 5. The apparatus according to any preceding embodiment, wherein the conductive equalizer comprises a sheet of material having a thermal conductivity, TC, wherein the sheet of material has a length, L, from a proximal end of the sheet directly thermally conductively connected to the conductive equalizer to a distal end of the sheet, a thickness T, and a width w, wherein L is in the range 0.05 m and 2 m, wherein T is greater than or equal to 0.000001 m, wherein T/L is in the range 0.0002 and 0.000005, wherein the sheet has an effective thermal conductance from the distal end to the proximal end equal to TC×w×T/L.

Embodiment 6. The apparatus according to any preceding embodiment, wherein the effective thermal conductance is at least 0.003 W/K, where W is watts and K is degrees Kelvin.

Embodiment 7. The apparatus according to any preceding embodiment, wherein the conductive equalizer covers at least 10% of the payload exposed surface.

Embodiment 8. The apparatus according to any preceding embodiment, wherein the conductive equalizer increases a surface area that is in direct thermal conductive contact with the thermal bank.

Embodiment 9. The apparatus according to any preceding embodiment, wherein the conductive equalizer extends the period of time the payload is maintained in a desired temperature range by conducting heat from the thermal bank toward the location the conductive equalizer is positioned.

Embodiment 10. The apparatus according to any preceding embodiment, wherein the conductive equalizer extremities are away from the cold bank from 50 mm to 2000 mm.

Embodiment 11. The apparatus according to any preceding embodiment, wherein the conductive equalizer is flexible.

Embodiment 12. The apparatus according to any preceding embodiment, wherein the conductive equalizer is semi-rigid.

Embodiment 13. The apparatus according to any preceding embodiment, wherein the conductive equalizer is rigid.

Embodiment 14. The apparatus according to any preceding embodiment, wherein the conductive equalizer has a thickness greater than or equal to 0.01 mm.

Embodiment 15. The apparatus according to any preceding embodiment, wherein the conductive equalizer comprises an insulation material on one or both surfaces of the conductive equalizer.

Embodiment 16. The apparatus according to any preceding embodiment, wherein the conductive equalizer comprises a plurality of thermal conductive materials.

Embodiment 17. The apparatus according to any preceding embodiment, wherein positioning the conductive equalizer around at least a portion of the payload comprises positioning the conductive equalizer on one side of the payload.

Embodiment 18. The apparatus according to any preceding embodiment, wherein positioning the conductive equalizer around at least a portion of the payload comprises positioning the thermal conduit on all sides of the payload.

Embodiment 19. The apparatus according to any preceding embodiment, further comprising positioning at least one additional conductive equalizer around a corresponding at least one additional portion of the payload, wherein at least a portion of each at least one additional thermal conduit has a thermal conductance of at least 10 W/m-K.

Embodiment 20. The apparatus according to any preceding embodiment, wherein the container incorporates insulation to insulate the interior of the container form the exterior of the container.

Embodiment 21. A method of thermally protecting a load, comprising:

positioning a load within an interior of a container;

positioning a conductive equalizer proximate to at least a portion of the load, wherein at least a portion of the conductive equalizer has a thermal conductivity of at least 10 W/mK, wherein positioning the conductive equalizer proximate the at least a portion of the load comprises positioning the conductive equalizer inside the container, direct thermal conductively connecting the conductive equalizer to a thermal bank, wherein the thermal bank is positioned within the interior of the container, wherein the thermal bank can absorb heat from the conductive equalizer or provide heat to the conductive equalizer, wherein the conductive equalizer extends the period of time the load is maintained in a desired temperature range.

Embodiment 22. The method according to embodiment 21, wherein the conductive equalizer comprises a material or multiple materials that allow heat to move from a first position in an interior of the container that has a high temperature to a second position in the interior of the container that has a lower temperature.

Embodiment 23. The method according to any of embodiments 21-22, wherein the conductive equalizer extends the period of time the payload is maintained in a desired temperature range by conducting heat from the location the conductive equalizer is positioned to the thermal bank.

Embodiment 24. The method according to any of embodiments 21-23, wherein the conductive equalizer comprises at least one part comprising one or more materials having a thermal conductivity in the range from 10 to 500 W/m-K.

Embodiment 25. The method according to any of embodiments 21-24, wherein the conductive equalizer has a combined thermal conductivity of at least 0.003 W/K.

Embodiment 26. The method according to any of embodiments 21-25, wherein the conductive equalizer comprises a sheet of material having a thermal conductivity, TC, wherein the sheet of material has a length, L, from a proximal end of the sheet directly thermally conductively connected to the conductive equalizer to a distal end of the sheet, a thickness T, and a width w, wherein L is in the range 0.05 m and 2 m, wherein T is greater than or equal to 0.000001 m, wherein T/L is in the range 0.0002 and 0.000005, wherein the sheet has an effective thermal conductance from the distal end to the proximal end equal to $TC \times w \times T/L$.

Embodiment 27. The method according to any of embodiments 21-26, wherein conductive equalizers covers at least 10% of the payload's exposed surface.

Embodiment 28. The method according to any of embodiments 21-27, wherein the conductive equalizer increases a surface area that is in direct thermal conductive contact with the thermal bank.

Embodiment 29. The method according to any of embodiments 21-28, wherein the conductive equalizer extends the period of time the payload is maintained in a desired temperature range by conducting heat from the thermal bank toward the location the conductive equalizer is positioned.

Embodiment 30. The method according to any of embodiments 21-29, wherein the conductive equalizer extremities are away from the cold bank from 50 mm to 2000 mm.

Embodiment 31. The method according to any of embodiments 21-30, wherein the conductive equalizer is flexible.

Embodiment 32. The method according to any of embodiments 21-31, wherein the conductive equalizer is semi-rigid.

Embodiment 33. The method according to any of embodiments 21-32, wherein the conductive equalizer is rigid.

Embodiment 34. The method according to any of embodiments 21-33, wherein the conductive equalizer has a thickness greater than or equal to 0.01 mm.

Embodiment 35. The method according to any of embodiments 21-34, wherein the conductive equalizer comprises an insulation material on one or both surfaces of the conductive equalizer.

Embodiment 36. The method according to any of embodiments 21-35, wherein the conductive equalizer comprises a plurality of thermal conductive materials.

Embodiment 37. The method according to any of embodiments 21-36, wherein positioning the conductive equalizer around at least a portion of the payload comprises positioning the conductive equalizer on one side of the payload.

Embodiment 38. The method according to any of embodiments 21-37, wherein positioning the conductive equalizer around at least a portion of the payload comprises positioning the thermal conduit on all sides of the payload.

Embodiment 39. The method according to any of embodiments 21-38, further comprising positioning at least one additional conductive equalizer around a corresponding at least one additional portion of the payload, wherein at least a portion of each at least one additional thermal conduit has a thermal conductance of at least 10 W/m-K.

Embodiment 40. The method according to any of embodiments 21-39, wherein the container incorporates insulation to insulate the interior of the container form the exterior of the container.

All patents, patent applications, provisional applications, and publications referred to or cited herein are incorporated by reference in their entirety, including all figures and tables, to the extent they are not inconsistent with the explicit teachings of this specification.

It should be understood that the examples and embodiments described herein are for illustrative purposes only and that various modifications or changes in light thereof will be suggested to persons skilled in the art and are to be included within the spirit and purview of this application.

REFERENCES

Dea, S. 2004. Thermal behavior of shipping containers for temperature sensitive pharmaceutical products. Master Thesis: Laval University, 202 pages.

Dea, S., J. Emond, and K. V. Chan. 2006. "New Approach in Packaging Development for Temperature Sensitive Products." American Pharmaceutical Outsourcing Journal. January/February 2006: 49-52.

We claim:

1. An apparatus for thermally protecting a load, comprising:

a container, wherein the container is configured to position the load within an interior of the container;

a thermal bank, wherein the thermal bank is configured to absorb heat from a source above an operating temperature of the thermal bank;

a conductive equalizer, wherein the load is positioned within the container, wherein at least a portion of the conductive equalizer has a thermal conductivity of at least 10 W/mK;

wherein the conductive equalizer is configured to be in direct thermal contact with the thermal bank, such that the thermal bank absorbs heat from the conductive equalizer or provides heat to the conductive equalizer, wherein, when the conductive equalizer is positioned proximate the load, a period of time the load is maintained in a desired temperature range is extended, wherein the conductive equalizer comprises a sheet of material having a thermal conductivity, TC, wherein the sheet of material has a length, L, from a proximal end of the sheet directly thermally conductively connected to the conductive equalizer to a distal end of the sheet, a thickness T, and a width w, wherein the sheet has an effective thermal conductance from the distal end to the proximal end equal to TC×w×T/L, and wherein the effective thermal conductance is at least 0.003 W/K, where W is watts and K is degrees Kelvin.

2. The apparatus according to claim 1, wherein the conductive equalizer comprises a material that allows heat to move from a first position in an interior of the container that has a high temperature to a second position in the interior of the container that has a lower temperature.

3. The apparatus according to claim 1, wherein the conductive equalizer extends the period of time the load is maintained in a desired temperature range by conducting heat from the location the conductive equalizer is positioned to the thermal bank.

4. The apparatus according to claim 1, wherein the conductive equalizer comprises at least one part comprising one or more materials having a thermal conductivity in the range from 10 to 500 W/m-K.

5. The apparatus according to claim 1, wherein L is in a range of 0.05 m to 2 m, wherein T is greater than or equal to 0.000001 m, and wherein T/L is in a range of 0.0002 to 0.000005.

6. The apparatus according to claim 1, wherein the conductive equalizer extends the period of time the load is maintained in a desired temperature range by conducting heat from the thermal bank toward the location the conductive equalizer is positioned.

7. The apparatus according to claim 1, wherein the conductive equalizer has a thickness greater than or equal to 0.01 mm.

8. The apparatus according to claim 1, wherein the conductive equalizer comprises an insulation material on one or both surfaces of the conductive equalizer.

9. A method of thermally protecting a load, comprising:

positioning a load within an interior of a container;

positioning a conductive equalizer proximate to at least a portion of the load, wherein at least a portion of the conductive equalizer has a thermal conductivity of at least 10 W/mK, wherein positioning the conductive equalizer proximate the at least a portion of the load comprises positioning the conductive equalizer inside the container, wherein the conductive equalizer is configured to be in direct thermal contact with a thermal bank, such that the thermal bank absorbs heat from the conductive equalizer or provides heat to the conductive equalizer, wherein the conductive equalizer extends a period of time the load is maintained in a desired temperature range, wherein the conductive equalizer comprises a sheet of material having a thermal conductivity, TC, wherein the sheet of material has a length, L, from a proximal end of the sheet directly thermally conductively connected to the conductive equalizer to a distal end of the sheet, a thickness T, and a width w, wherein the sheet has an effective thermal conductance from the distal end to the proximal end equal to TC×w×T/L, and wherein the effective thermal conductance is at least 0.003 W/K, where W is watts and K is degrees Kelvin.

10. The method according to claim 9, wherein the conductive equalizer comprises a material that allow heat to move from a first position in an interior of the container that has a high temperature to a second position in the interior of the container that has a lower temperature.

11. The method according to claim 9, wherein the conductive equalizer extends the period of time the load is maintained in a desired temperature range by conducting heat from a location the conductive equalizer is positioned to the thermal bank.

12. The method according to claim 9, wherein the conductive equalizer comprises at least one part comprising one or more materials having a thermal conductivity in a range from 10 to 500 W/m-K.

13. The method according to claim 9, wherein L is in a range of 0.05 m to 2 m, wherein T is greater than or equal to 0.000001 m, and wherein T/L is in a range of 0.0002 to 0.000005.

14. The method according to claim 9, wherein the conductive equalizer extends the period of time the load is maintained in a desired temperature range by conducting heat from the thermal bank toward the location the conductive equalizer is positioned.

15. The method according to claim 9, wherein the conductive equalizer has a thickness greater than or equal to 0.01 mm.

16. The method according to claim 9, wherein the conductive equalizer comprises an insulation material on one or both surfaces of the conductive equalizer.

* * * * *